US005785605A

United States Patent [19]

Helmstetter

[11] Patent Number: 5,785,605

[45] Date of Patent: Jul. 28, 1998

[54] HOLLOW, METALLIC GOLF CLUB HEAD WITH CONFIGURED MEDIAL RIDGE

[75] Inventor: Richard C. Helmstetter, Carlsbad, Calif.

[73] Assignee: Callaway Golf Company, Carlsbad, Calif.

[21] Appl. No.: 548,816

[22] Filed: Jan. 11, 1996

[51] Int. Cl.[6] ..... A63B 53/04

[52] U.S. Cl. ..... 473/291; 473/345; 473/328; 473/349

[58] Field of Search ..... 473/324, 327, 473/328, 332, 343, 344, 345, 346, 349, 350, 282, 290, 291, 256

[56] References Cited

U.S. PATENT DOCUMENTS

| | | | |
|---|---|---|---|
| D. 94,549 | 2/1935 | Jansky . | |
| D. 225,419 | 12/1972 | Mills . | |
| D. 307,783 | 5/1990 | Ilnuma . | |
| D. 318,087 | 7/1991 | Helmstetter . | |
| 1,167,106 | 1/1916 | Palmer . | |
| 1,568,888 | 1/1926 | Dunn . | |
| 1,582,836 | 4/1926 | Link . | |
| 1,619,566 | 3/1927 | Crankshaw . | |
| 1,658,581 | 2/1928 | Tobia . | |
| 1,669,482 | 5/1928 | Miller . | |
| 1,868,286 | 7/1932 | Grieve . | |
| 1,916,792 | 7/1933 | Hadden . | |
| 1,946,208 | 2/1934 | Hampton . | |
| 2,041,676 | 5/1936 | Gallagher . | |
| 2,087,685 | 7/1937 | Hackney . | |
| 2,201,638 | 5/1940 | Theibault, Sr. . | |
| 2,460,435 | 2/1949 | Schaffer . | |
| 2,960,338 | 11/1960 | Havey et al. . | |
| 3,212,783 | 10/1965 | Bradley et al. . | |
| 3,761,095 | 9/1973 | Thompson . | |
| 3,815,921 | 6/1974 | Turner . | |
| 3,941,390 | 3/1976 | Hussey | 473/292 |
| 3,976,299 | 8/1976 | Lawrence et al. . | |
| 4,147,349 | 4/1979 | Jeghers | 473/291 |
| 4,214,754 | 7/1980 | Zebelean . | |
| 4,280,700 | 7/1981 | Plagenhoef | 473/291 |
| 4,313,607 | 2/1982 | Thompson . | |
| 4,322,083 | 3/1982 | Imai . | |
| 4,332,388 | 6/1982 | Crow . | |
| 4,432,549 | 2/1984 | Zebelean . | |
| 4,511,145 | 4/1985 | Schmidt . | |
| 4,681,321 | 7/1987 | Chen et al. . | |
| 4,756,534 | 7/1988 | Thompson . | |
| 4,809,977 | 3/1989 | Doran et al. . | |
| 4,840,380 | 6/1989 | Kajita et al. | 473/291 |
| 4,854,581 | 8/1989 | Long . | |
| 4,872,685 | 10/1989 | Sun . | |
| 4,930,781 | 6/1990 | Allen . | |
| 5,028,049 | 7/1991 | McKeighen | 473/345 |
| 5,042,806 | 8/1991 | Helmstetter . | |
| 5,067,715 | 11/1991 | Schmidt et al. . | |
| 5,180,166 | 1/1993 | Schmidt et al. . | |
| 5,240,252 | 8/1993 | Schmidt et al. . | |
| 5,271,620 | 12/1993 | Moriguchi et al. . | |
| 5,288,079 | 2/1994 | Katayama | 473/328 |
| 5,301,945 | 4/1994 | Schmidt et al. . | |
| 5,460,376 | 10/1995 | Schmidt et al. | 473/328 |
| 5,480,152 | 1/1996 | Schmidt et al. | 473/290 |

FOREIGN PATENT DOCUMENTS

| | | |
|---|---|---|
| 1476889 | 6/1977 | United Kingdom . |
| 2100993 | 1/1983 | United Kingdom . |
| 2225726 | 6/1990 | United Kingdom . |
| 2230459 | 10/1990 | United Kingdom . |

*Primary Examiner*—Sebastiano Passaniti
*Attorney, Agent, or Firm*—William W. Haefliger

[57] ABSTRACT

In combination with a golf club head which comprises a shell having toe and heel portions, a front wall defining a forward facing ball-striking face, and top and bottom walls, the bottom wall characterized as having a medial ridge, the improvement comprising a medial ridge having shallow downward convexity in an upright plane extending forwardly and intersecting the ridge, the ridge having a lowermost local zone, in ball-addressing position of the head, and the head having a center of gravity located in substantially vertical alignment with the local zone.

53 Claims, 19 Drawing Sheets

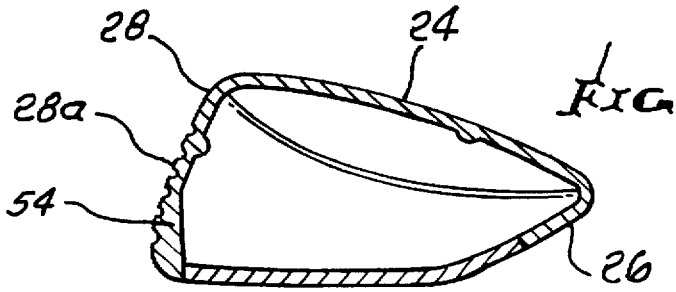
FIG. 6.
FIG. 7.
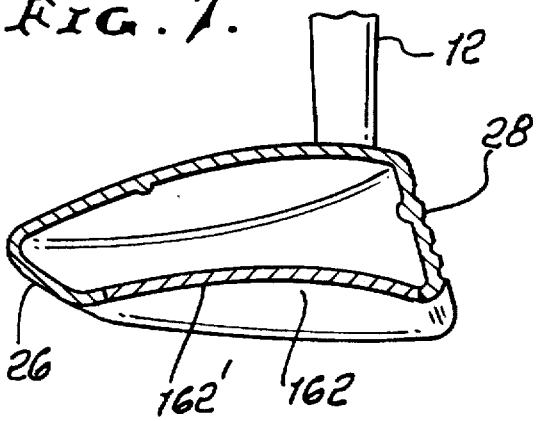
FIG. 8.
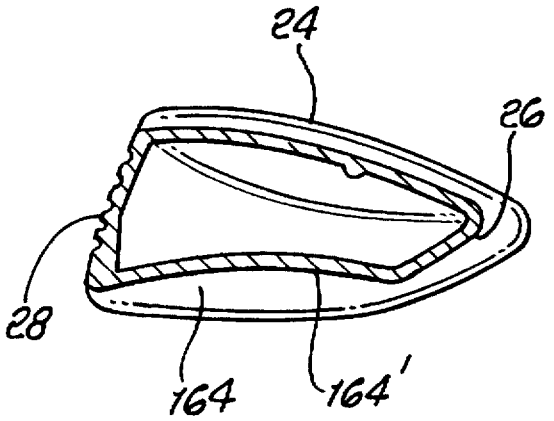
FIG. 9.
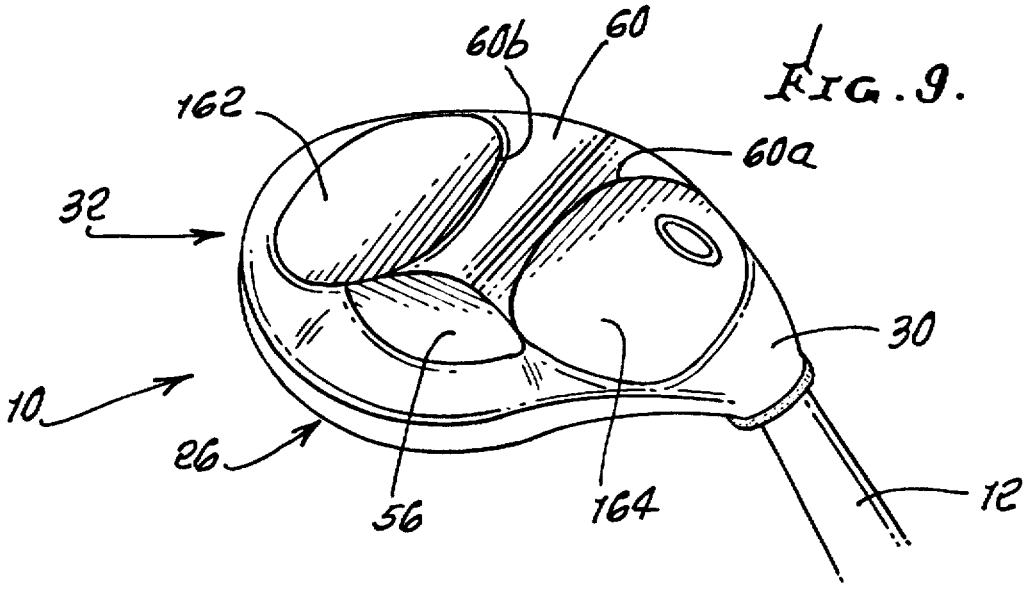

FIG. 10.
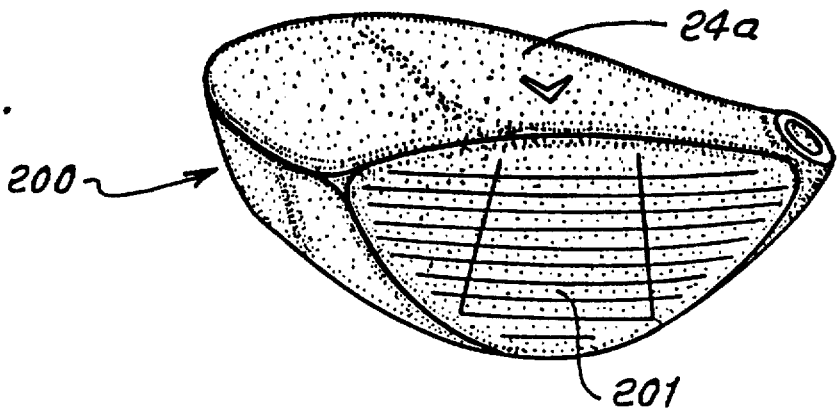
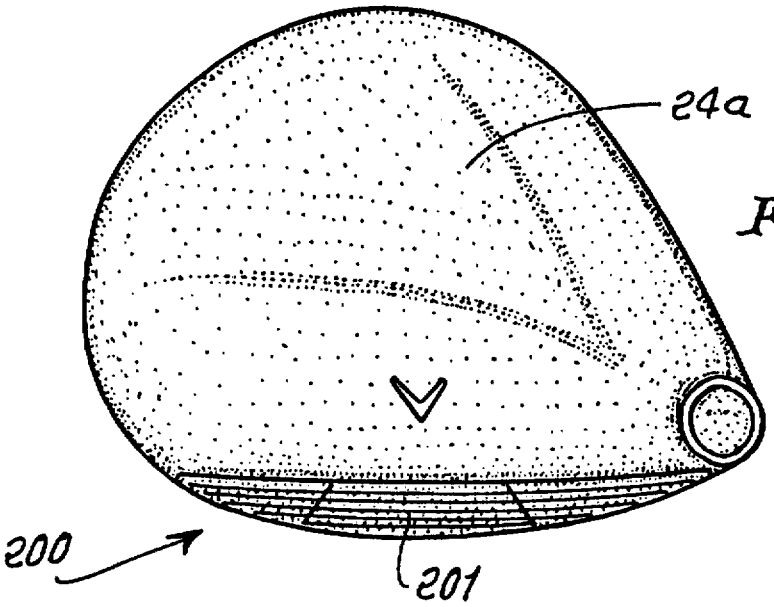
FIG. 11.
FIG. 12.
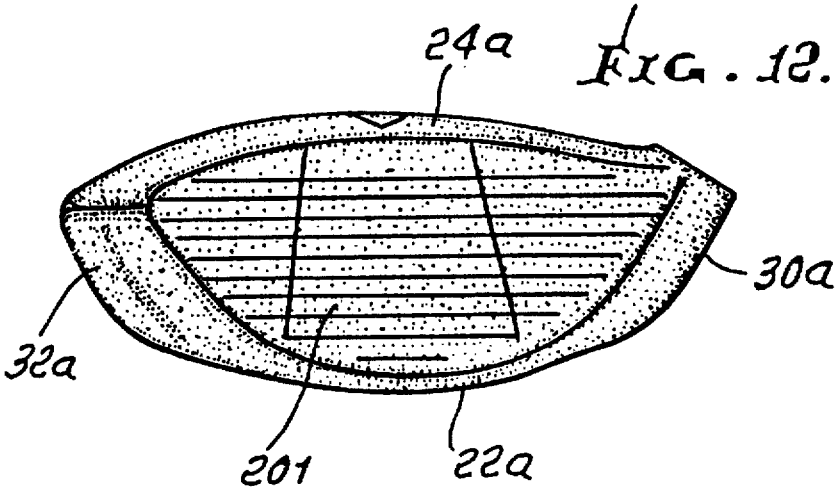

FIG. 41.
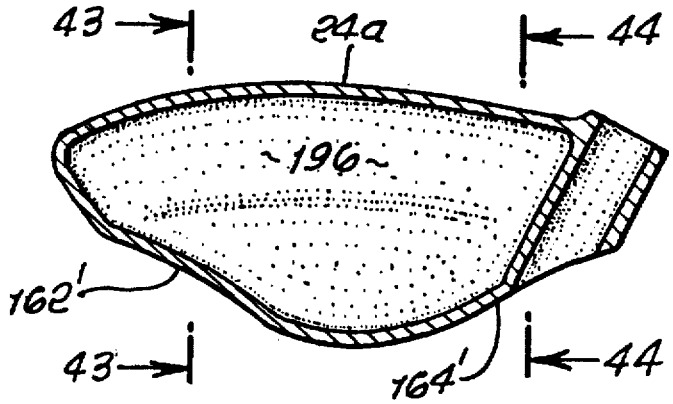
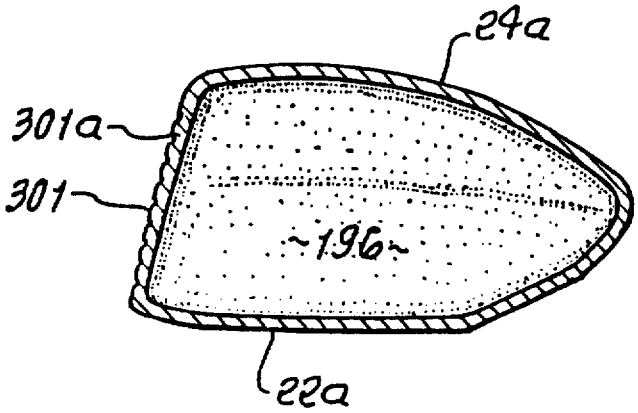
FIG. 42.
FIG. 43.
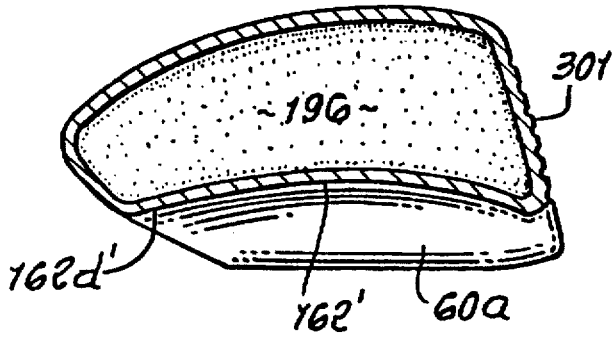
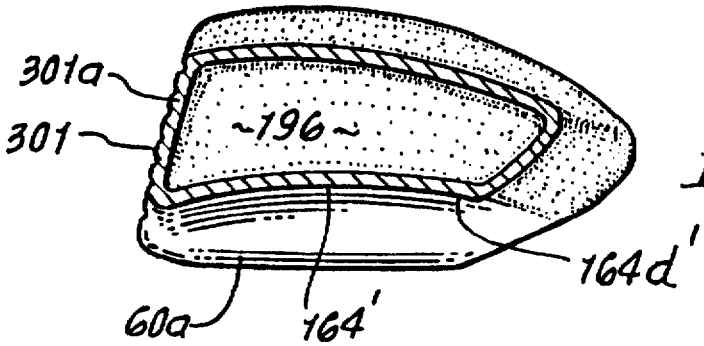
FIG. 44.

FIG. 51.
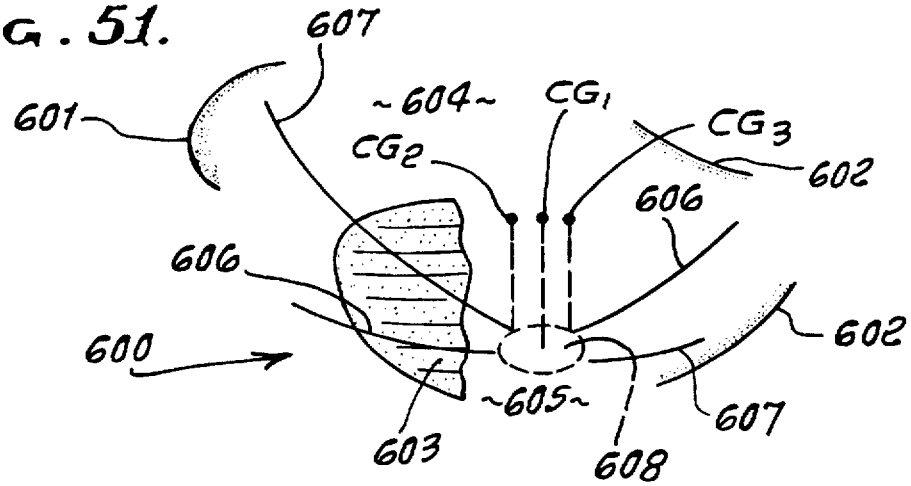
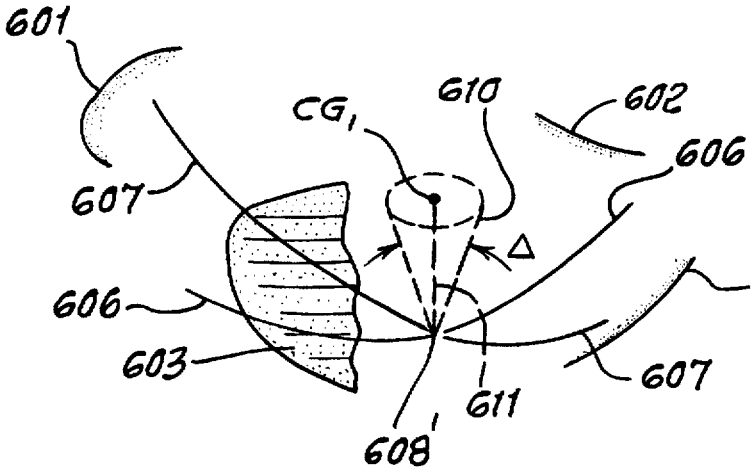
FIG. 52.
FIG. 53.
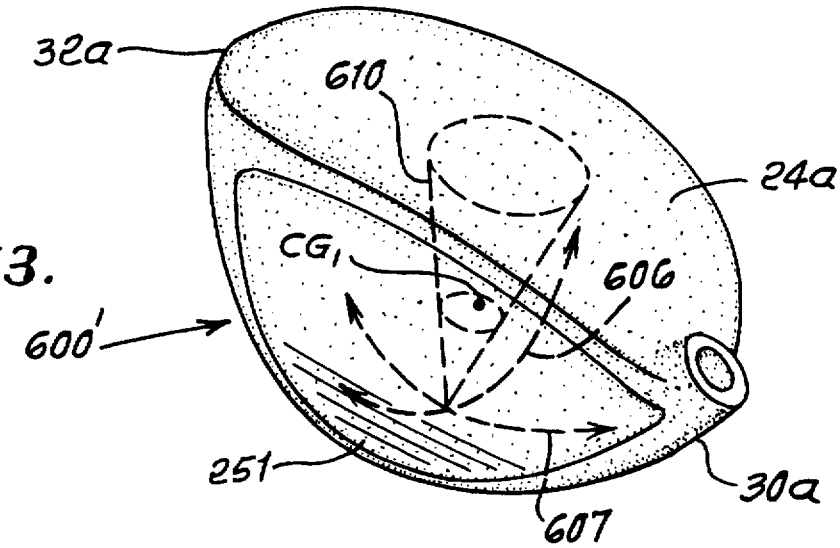

HOLLOW, METALLIC GOLF CLUB HEAD WITH CONFIGURED MEDIAL RIDGE

BACKGROUND OF THE INVENTION

This invention relates generally to provision of golf club head surfaces that provide for head "bounce", upon engagement with the turf during club swinging, thereby to minimize loss of forward momentum of the head. The invention has particular reference to improvements in golf club heads characterized by relating head bottom wall configuration to center of gravity location, so as to realize these objectives.

SUMMARY OF THE INVENTION

It is a major object of the invention to provide head structural modifications that provide for the "bounce" effect referred to.

Basically, the invention is embodied in an improved head having toe and heel portions, a front wall defining a forward facing ball-striking face, and top and bottom walls, the bottom wall characterized as having a medial ridge, with shallow downward convexity in an upright plane extending longitudinally forwardly and intersecting the ridge. Typically, the ridge has a lowermost local zone, in ball-addressing position of the head, and the head has a center of gravity located in substantially vertical alignment with that local zone. Also, ridge downward convexity strengthens the thin bottom wall against deformation in response to shock impact loading.

As will appear, the shallow downward convexity may extend throughout the major length of the ridge, and two shallow recesses may be provided at opposite sides of the ridge.

Another object is to provide a golf club head bottom wall that terminates forwardly at a beveled portion and that is shaped forwardly and upwardly at an angle substantially less than 45°, relative to horizontal. The beveled portion typically extends at the forwardmost extent of the medial ridge; and it may extend forwardly of the two shallow recesses, as referred to. Also, the described downward convexity may typically merge with the beveled portion that extends at the forwardmost extent of the head.

Another object is to provide bevel angularity at between 22° and 38°, and preferably about 30°, as will appear.

Yet another object is to provide a golf club head having a toe, a heel, a forwardly facing ball-striking face, and top and bottom walls, the bottom wall having downward convexity in a front-to-rear direction, and downward convexity in a toe-to-heel direction, the bottom wall having a lowermost local zone toward which the convexities converge, in ball-addressing position of the head, and the head having a center of gravity located in vertical alignment with that local zone.

The head local zone may define an apex toward which the convexities converge. The center of gravity is then typically located within an upwardly divergent cone originating at the apex, the cone having a vertical axis and defining a 15° included angle.

A further object is to provide a set of heads, as referred to, which includes heads, having lofts from 4° to 45°. Examples are:

a) a metal wood having a front face inclined at approximately 9° from vertical, b) a metal wood having a front face inclined at approximately 11° from vertical, c) a metal 2 wood, d) a metal 4 wood, e) a metal 5 wood.

Yet another object of the invention is to provide a set of heads characterized by "bounce" structure, as referred to, and by one of the following:

a) at least one head has its center of gravity located at approximately 42% to 50% of the head height, as measured upwardly from the lowermost head surface to the uppermost head surface, viewed from the front of the head, b) each of at least two of the heads has a center of gravity located at approximately 42% to 50% of the head height as measured upwardly from the lowermost head surface to the uppermost head surface, viewed from the front of the head.

A still further object is to provide an improved golf club head, and method of forming same, to incorporate improvements in construction, mode of operation and result, as referred to herein.

These and other objects and advantages of the invention, as well as the details of an illustrative embodiment, will be more fully understood from the following specification and drawings, in which:

DRAWING DESCRIPTION

FIG. 6 is an elevation taken in section on lines 6—6 of FIG. 2;

FIG. 7 is an elevation taken in section on lines 7—7 of FIG. 5;

FIG. 8 is an elevation taken in section on lines 8—8 of FIG. 5;

FIG. 9 is a perspective view showing the bottom, rear, and heel end of the FIG. 1 club head;

FIG. 10 is a perspective view showing the top, front and toe regions of a golf club driver head having 9° front face inclination;

FIG. 11 is a top plan view of the FIG. 10 head;

FIG. 12 is a front face elevation view of the FIG. 10 head;

FIG. 41 is a section taken in elevation on lines 41—41 of FIG. 25;

FIG. 42 is a section taken in elevation on lines 42—42 of FIG. 25;

FIG. 43 is a section taken in elevation on lines 43—43 of FIG. 41;

FIG. 44 is a section taken in elevation on lines 44—44 of FIG. 41;

FIG. 51 is a schematic perspective view showing center of gravity determination;

FIG. 52 is another schematic perspective view;

FIG. 53 is a view like FIG. 52 but also showing a complete golf club head superimposed over a center of gravity determination;

DETAILED DESCRIPTION

Figure 1:
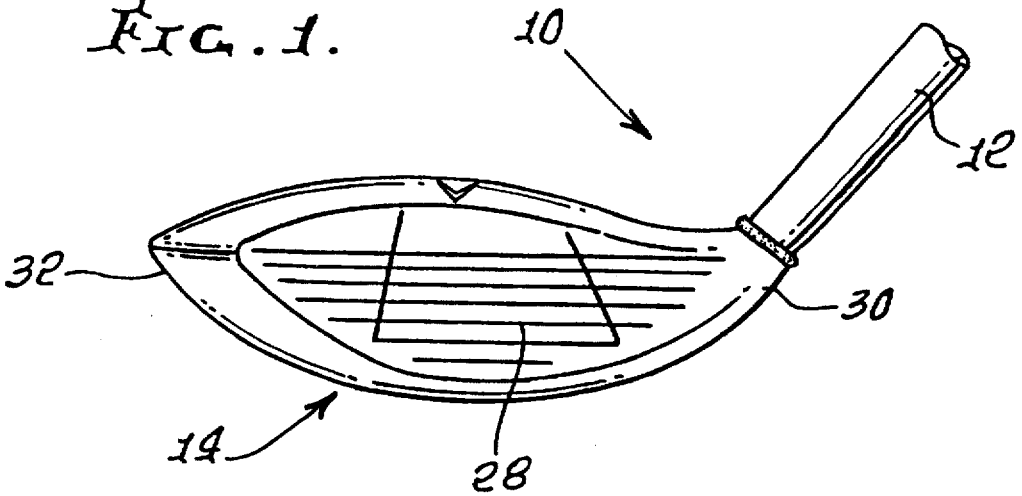
FIG. 1 is a front elevational view of a golf club head incorporating the invention.

Referring now to the drawings, a golf club 10, in accordance with a preferred embodiment of the present invention, is shown. The club 10 includes a shaft 12 (only the lower portion of which is shown), which is attached to a head 14. The head 14 is in the configuration of a "wood" club, although it is made of metal. As shown in FIGS. 5–8, the head comprises a hollow, metal shell 16.

The shell 16 may be made of stainless steel or titanium, for example, other metallic compositions being usable; and it may be fabricated by the "lost wax" casting method that is well known in the art. The shell 16 may, for example, be formed in two pieces: a main portion 20 and a sole plate 22, which is peripherally welded to the main portion 20.

The main shell portion 20 has a top surface 24, a rear surface 26, and a ball-striking surface or face 28 opposite the rear surface 26. The face 28 is angled with respect to the vertical with a specified "pitch" that is determined by the type of club and the amount of loft desired. The end portion of the head 14 proximate the shaft 12 is commonly termed the "heel" 30, while the end portion opposite the heel 30 is termed the "toe" 32.

Figure 2:
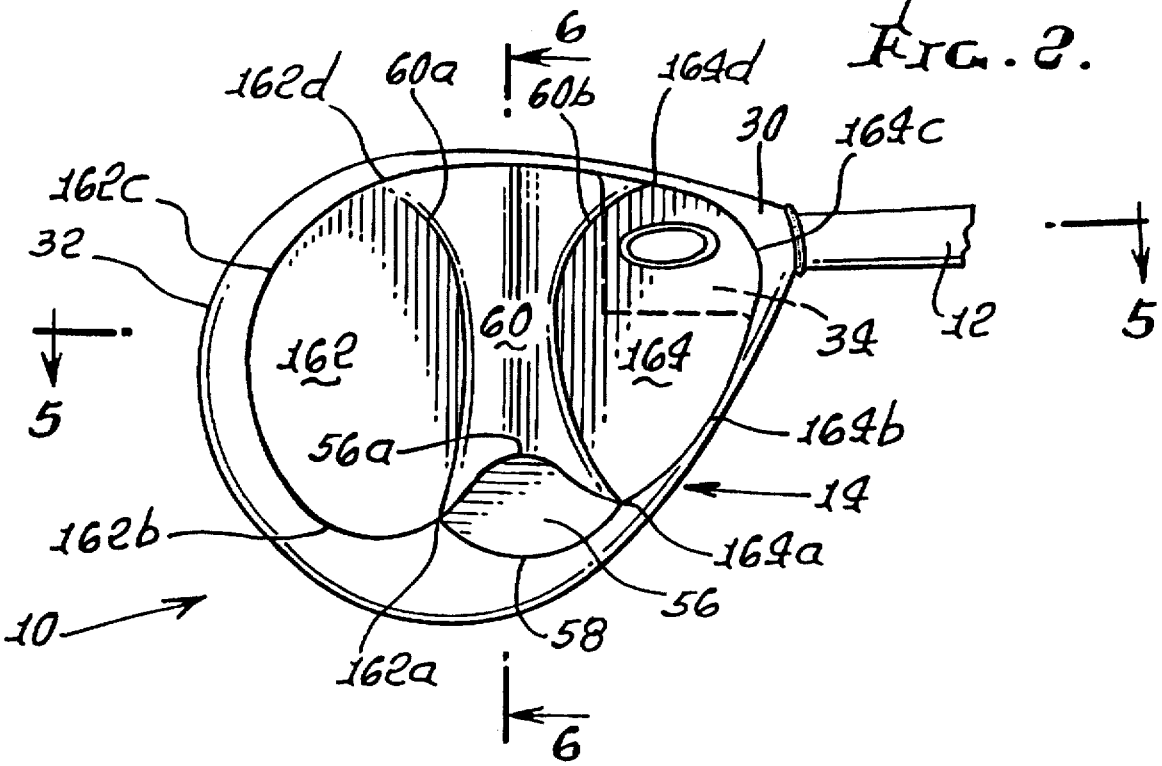
FIG. 2 is a plan view of the bottom of the FIG. 1 head.
Figure 3:
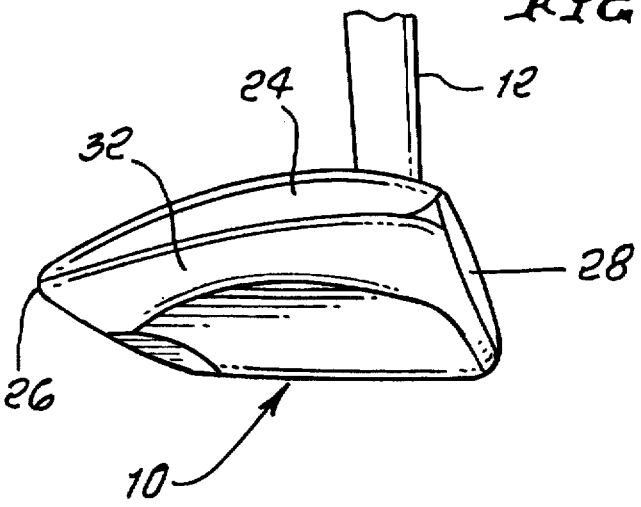
FIG. 3 is an elevational view of the toe end of the FIG. 1 head.
Figure 4:
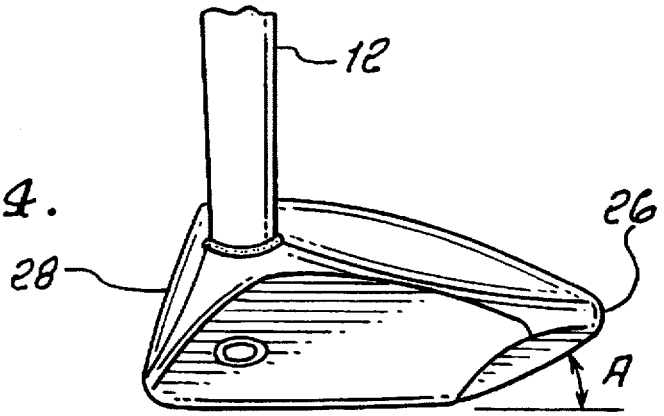
FIG. 4 is an elevational view of the heel end of the FIG. 1 head.
Figure 5:
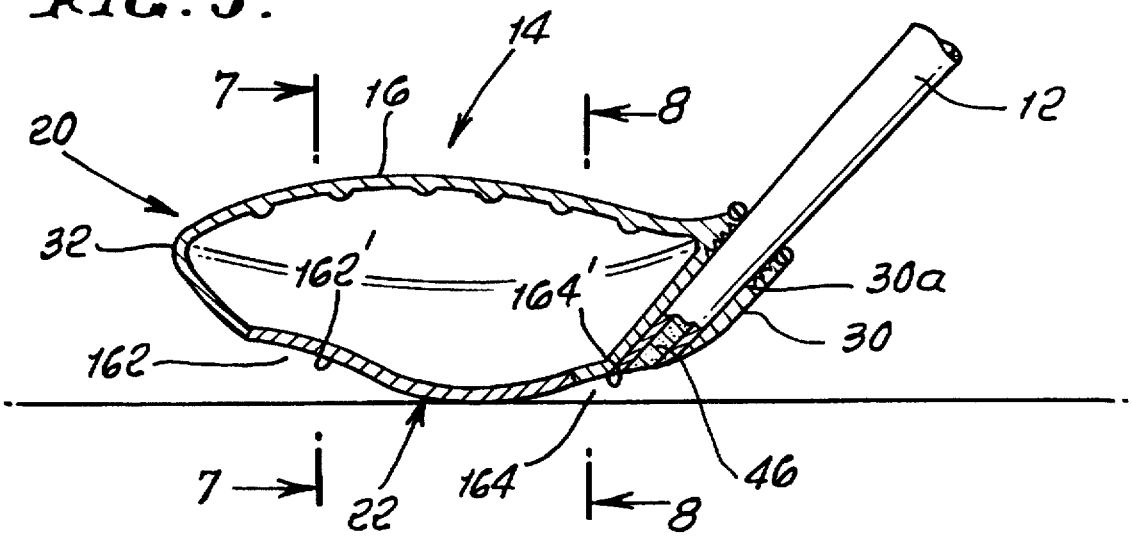
FIG. 5 is an elevation taken in section on lines 5—5 of FIG. 2.
Figure 13:
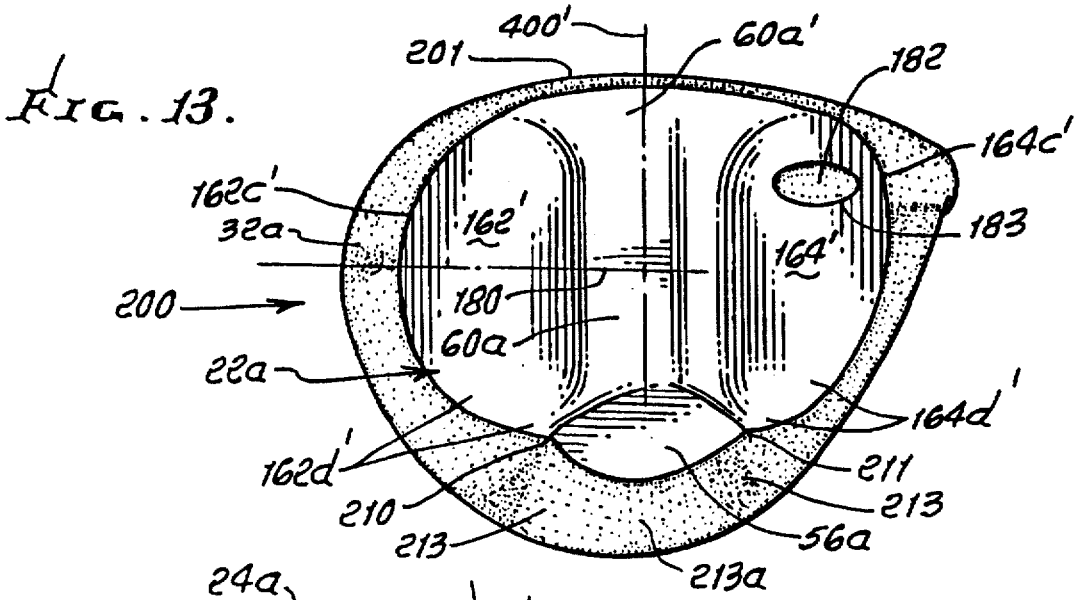
FIG. 13 is a bottom plan view of the FIG. 10 head.
Figure 14:
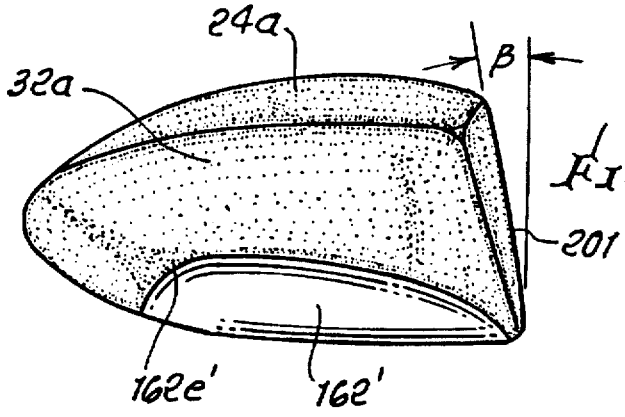
FIG. 14 is a toe end elevation view of the FIG. 10 head.
Figure 15:
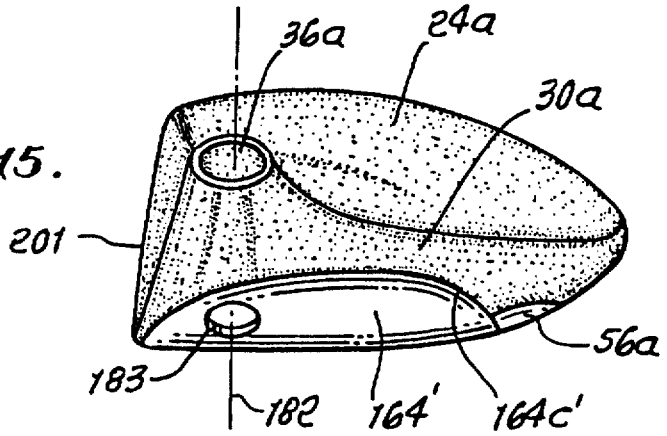
FIG. 15 is a heel end elevation view of the FIG. 10 head.
Figure 16:
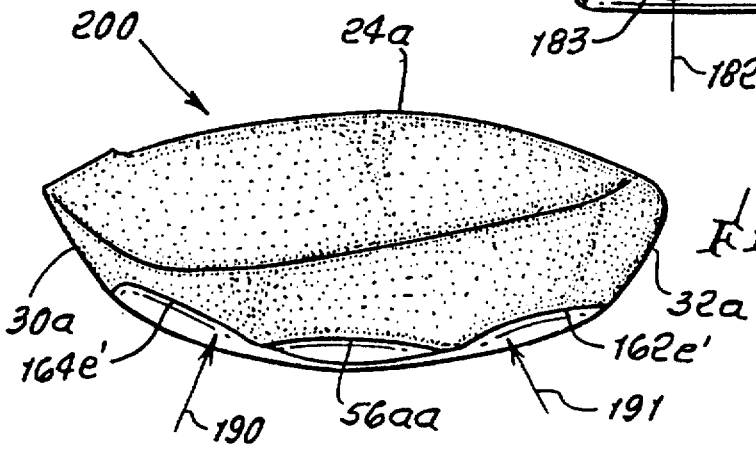
FIG. 16 is a rear elevation view of the FIG. 10 head.
Figure 17:
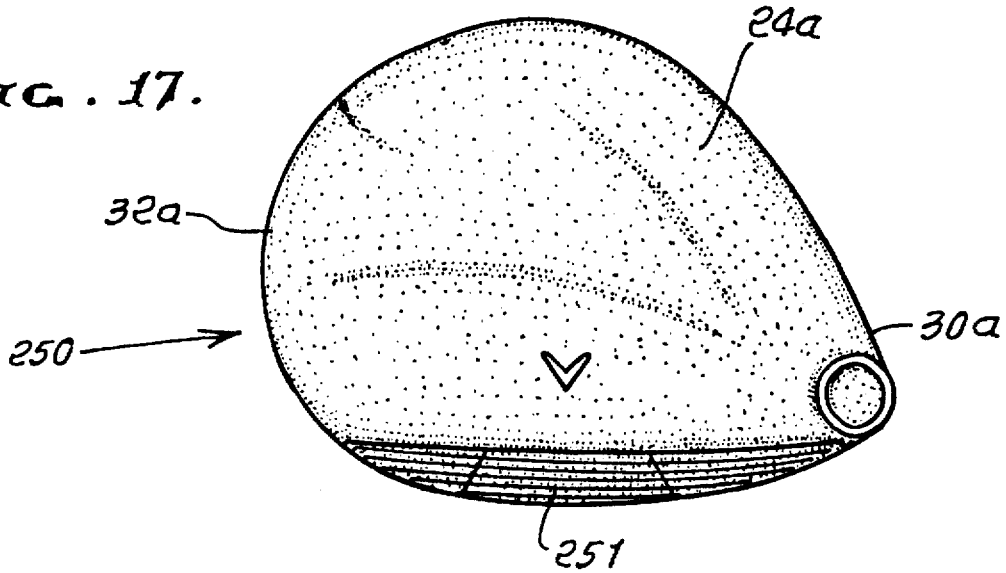
FIG. 17 is a top plan view of a golf club head, like the head of FIGS. 10–16, but having 11° front face inclination.
Figure 18:
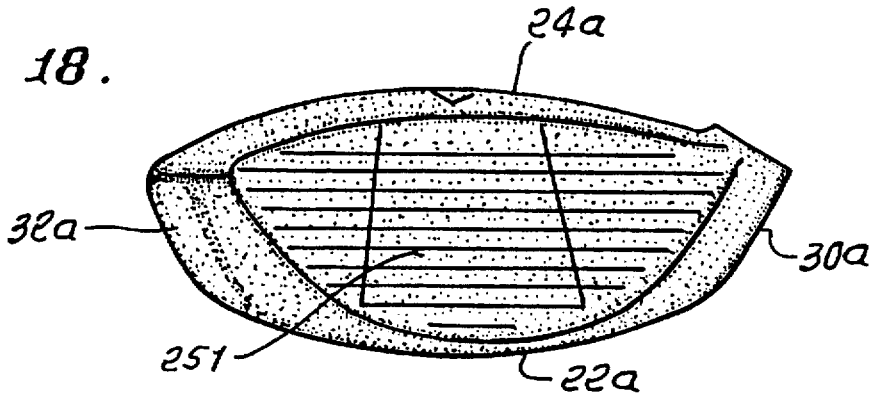
FIG. 18 is a front face elevational view of the FIG. 17 head.
Figure 19:
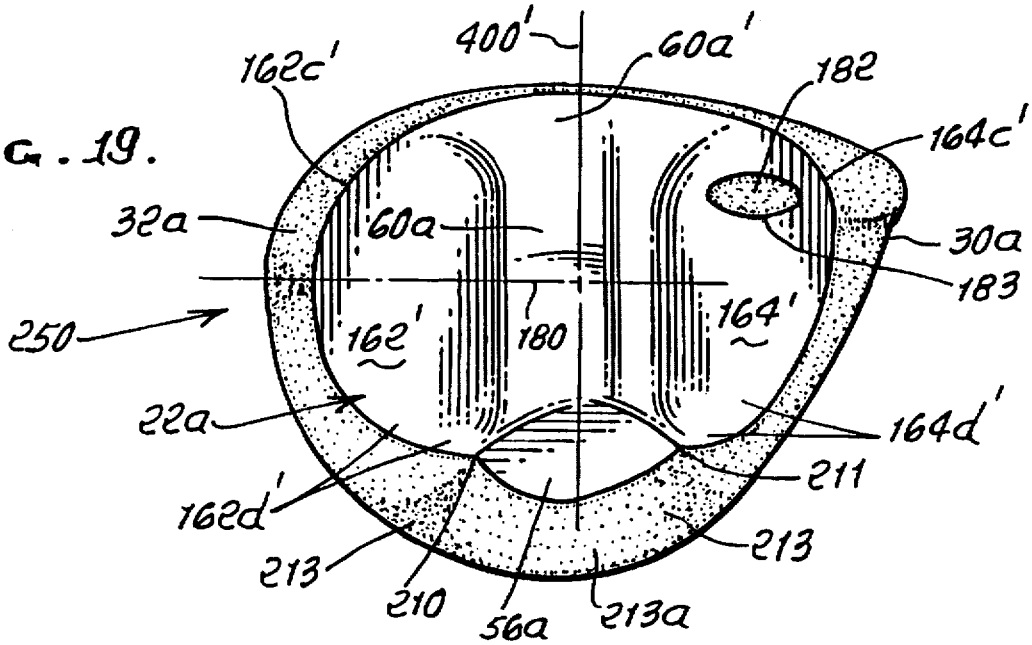
FIG. 19 is a bottom plan view of the FIG. 17 heads.
Figure 20:
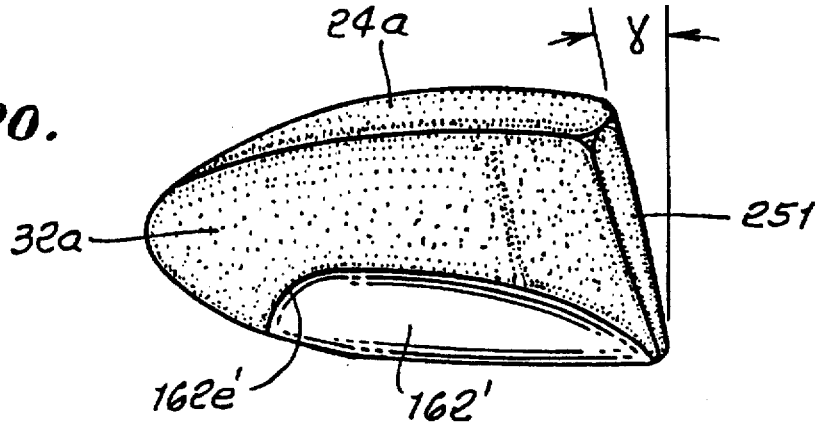
FIG. 20 is a toe end elevational view of the FIG. 17 head.
Figure 21:
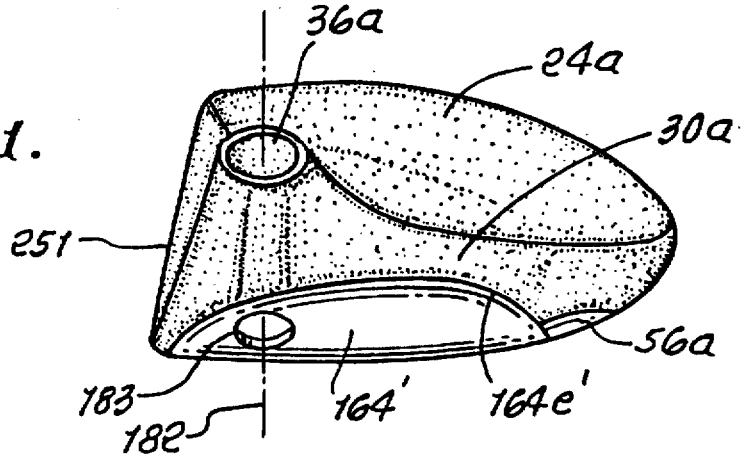
FIG. 21 is a heel end elevational view of the FIG. 17 head.
Figure 22:
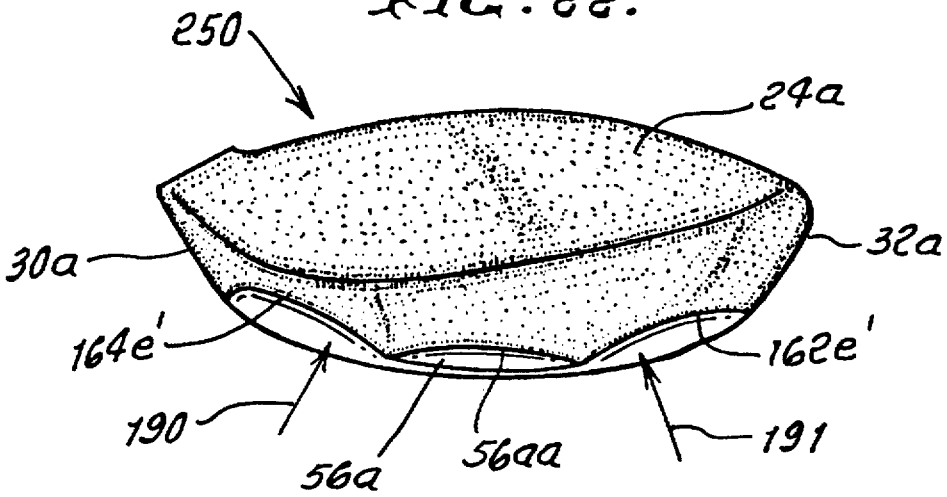
FIG. 22 is a rear elevational view of the FIG. 17 head.
Figure 23:
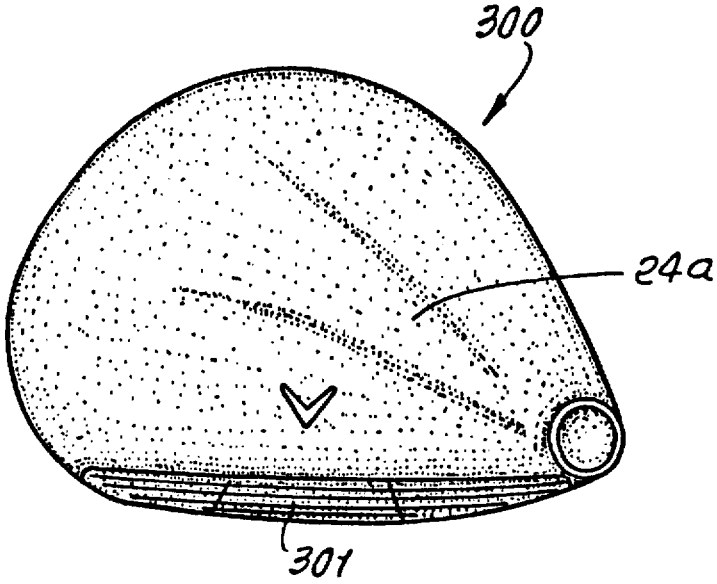
FIG. 23 is a top plan view of a golf club head, similar to the heads of FIGS. 10–22, but configured as a 2 wood.
Figure 24:
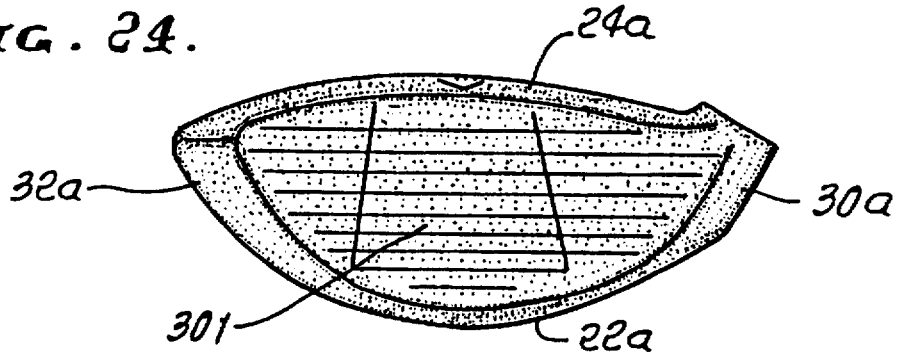
FIG. 24 is a front face elevation view of the FIG. 23 head.
Figure 25:
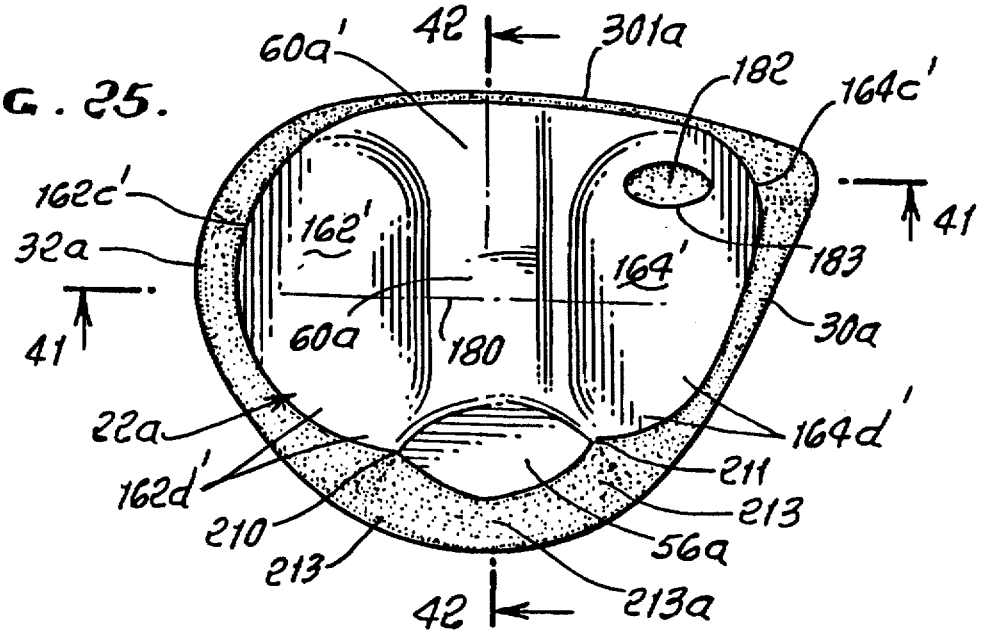
FIG. 25 is a bottom plan view of the FIG. 23 head.
Figure 26:
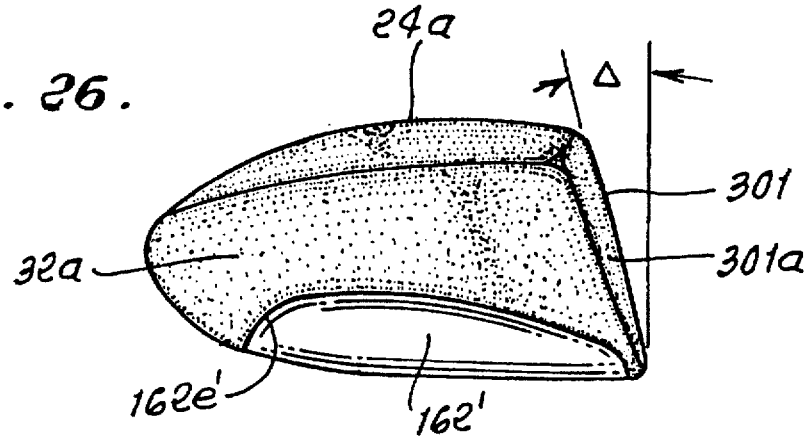
FIG. 26 is a toe end elevation view of the FIG. 23 head.
Figure 27:
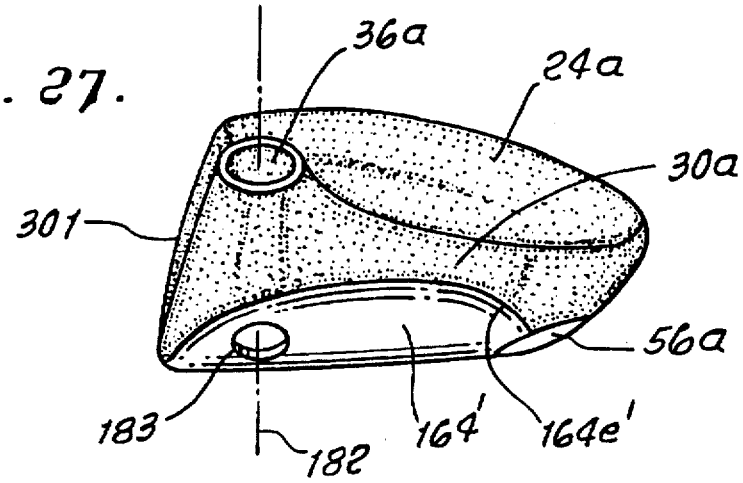
FIG. 27 is a heel end elevation view of the FIG. 23 head.

As shown in FIG. 2, the face 28 is typically curved from the heel 30 to the toe 32. The main shell portion 20 has a bottom corner portion 34 that is cast integrally with the front wall 28*a* and with the heel wall 30*a*, and flush with the sole plate 22, and that forms a bottom surface or sole in combination with the sole plate 22 when the two shell portions are welded together, if two shell portions are used.

A golf club, in accordance with a preferred embodiment of the invention, includes the sole configuration shown in the drawings.

As shown in the drawings, the bottom wall is characterized as forming a medial ridge 60, and as forming two shallow recesses—one recess between the ridge and the heel portion, and the other recess between the ridge and the toe portion—the recesses everywhere spaced rearwardly from the front wall. Examples of such shallow, upwardly dished recesses are seen at 162 between the ridge 60 and the toe 32, and at 164 between the ridge and heel 30.

The upward bi-directional concavity of the bottom wall extents 162' and 164' forming the recesses adds to bottom wall strength and stiffness, for transmitting shock loading transmitted to and from the front wall 28 during ball stroking. The bottom wall thickness may then be minimized and metal "redistributed" to enable provision of a larger sized head.

Note also the provision of a bottom wall rearwardly divergent surface that extends at a rearwardly and upwardly extending angle, beyond rearward extent of the ridge, and between rearward extents of the recesses.

Specifically, there is a trailing surface 56, which is a relieved, upwardly angled, somewhat flattened portion extending upwardly from a curved edge 56*a*, and between that edge and the center of the sole and a trailing edge 58 at the juncture between the rear surface 26 of the club head and the sole plate 22. The lowermost curved part 56*a* of the surface 56 is contiguous with the rearward end of ridge 60 that extends forwardly toward and diverges at 60*a* and 60*b* to merge laterally with the bottom U-shaped edge of the face 28 of the club head.

The trailing surface 56 preferably extends at an angle A of approximately 18° with respect to the horizontal. The angle A may be varied by plus or minus up to 5°, depending on the type of club and the preference of the player. The trailing surface 56 minimizes the club head's closing, or "hooding", when the ball is hit "fat", while reducing the overall aerodynamic drag of the club head to maximize its attainable velocity during the swing.

Further, in regard to the described combination of bottom wall contours, the ridge downward curvature rearwardly of the front face, and between the dished recesses 162 and 164, enables the sole to glide over the turf, for resisting and repelling the turf against the dished out zones 162 and 164, to limit penetration in proportion to, or accordance with, the unique shape of the sole as a unit, in a unique way, the front face having a downward U-shape forward of the recesses and ridge, as is clear from FIGS. 1 and 2. Note the ridge diverging forwardly toward the U-shaped front face.

Accordingly, a golf ball having a "bad lie" can be approached in a confident way, to "dig" the ball out by means of a club stroke characterized in that the club head sole planes over the turf, considering the turf as fluid. For a golf ball having a more conventional lie, no "digging out" is required, and an improved downward sole shape "footprint" is produced on the turf, as will be referred to.

A further aspect concerns the provision of a golf club head having a metal shell defining top, bottom, front, rear, toe, and heel walls, and wherein:

a) the bottom wall has upwardly recessed wall extent, b) the upwardly dished wall extent defining downward facing surface means inclined forwardly and upwardly relative to the head swing path as the bottom wall engages the turf, so that the turf moving relatively rearwardly engages the inclined surface means for creating lift force acting to urge the bottom wall and the head in an upward direction, whereby drag is reduced and more kinetic energy is available for transfer to the ball.

Further, and as described, the bottom wall also has a downward facing medial ridge 60, which extends generally forwardly, the dished or recessed wall extent preferably including two recessed extents 162 and 164, respectively, located at opposite sides of the ridge, each of the two recessed extents defining a portion of the inclined surface means (at the rears of the recessed extents 162 and 164), whereby upward lift forces are developed at opposite sides of the ridge, for torsionally balanced upward lift imparted to the head.

Finally, the turf controlling head bottom wall can be formed or cast integrally with the remainder of the head, if desired, i.e., it need not be separately formed and later welded to a rim defined by a separately cast head. Such forming may be by a casting or molding process employing metallic or non-metallic material.

The bottom wall and/or the rest of the head can be made of materials other than metal.

As used herein, the word "turf" shall be understood to mean grass, weeds, sand, mud, and other material engageable and displaceable by the bottom wall of the head.

Referring now to FIGS. 10–16, the metal wood head 200 shown has a front face 201 with inclination β from vertical (see FIG. 14) which is 9°, i.e., the wood is a driver. The metal wood head 250 shown in FIGS. 17–22 is like the head of FIGS. 10–16, but the front face 251 has inclination γ from vertical (see FIG. 20) which is 11°.

The metal wood head 300 of FIGS. 23–28 is like the head of FIGS. 17–22, but the front face 301 is angled at Δ at greater than 110, and the wood is a 2 wood. As such, it is slightly smaller in overall size than the head of FIGS. 10–22.

The head 350 of FIGS. 29–34 is FIGS the head of FIGS. 23–28, but the front face 351 has greater angular inclination at Ø from vertical than the 2 wood of FIGS. 23–28. The head 350 of FIGS. 29–34 is a 4 wood. Head 350 is slightly smaller in overall size, including height, than the head of FIGS. 23–28.

Finally, the head 400 of FIGS. 35–40 is like the head of FIGS. 29–34, but its front face 401 has greater angular inclination at π from vertical than the head 4 wood of FIGS. 29–34. The head 400 is a 5 wood. Head 400 is also slightly smaller in overall size, including height, than the head 350 of FIGS. 29–34.

The heads 200, 250, 300, 350, and 400 constitute a set of similar and related heads that are typically carried in a golf bag of a golfer. Note the similar configurations of the head bottom walls, which are similar to the bottom wall of the head of FIGS. 1–9.

Referring to the head 300 of FIGS. 23–28, as an example of the similar configurations of the FIG. 10–40 heads, it includes a shell having toe and heel portions **32*a* and 30*a*, a front wall 301*a* defining ball striking face 301, and top and bottom walls 24*a* and 22*a*. The bottom wall of each head has a medial ridge 60*a*, and forms two dished, similar shallow recesses 162' and 164'—one recess between the ridge and heel portion, and the other recess between the ridge and toe portion. The recesses are located rearwardly of the front wall 301*a*—one recess 164' having an arcuate peripheral edge 164*c*' generally convex toward the heel portion, and the other recess 162' having an arcuate peripheral edge 162*c*'** generally convex toward the toe portion.

As shown, each recess 162' and 164' has a downward facing surface and is further characterized in that, for each head:

i) a vertical plane 180 bisecting the recess in a toe to heel direction intersects the recess surface along a downwardly concave line (see FIG. 41), and ii) a vertical plane bisecting each recess in a front to rear direction relative to the head intersects the recess surface along a downwardly concave line (see FIGS. 43 and 44).

Further, and as shown, the two recesses of each head have similar configuration (see FIG. 25), with respect to a vertical plane that bisects the ridge in a front to rear direction relative to the head. See FIG. 42.

It will also be seen that each recess has a downward facing surface and is further characterized in that, for each head:

i) the rearwardmost extents **162*d*' and 164*d*', of the downwardly facing surfaces are inclined forwardly and upwardly relative to the head forward swing path, as the head bottom wall engages the turf (see FIGS. 25, 43 and 44**), ii) whereby balanced lift forces are created in response to engagement of the rearwardmost extents of the surfaces with the turf as the head is swung forwardly along the path, the lift forces acting to urge the head bottom wall and the head in an upward direction.

The medial ridge **60*a* increases in width at 60*a*' toward the front wall and between forward extents of the two recesses 162' and 164'. Beyond rearward extent of the ridge, the bottom wall has a rearwardly divergent surface 56*a*** that extends rearwardly and upwardly, that surface, for example, being flattened, and that surface merging with the recesses at cusps that are substantially equidistant from the head front wall, contributing to balanced lift force creation.

The bottom wall **22*a*** may be in part defined by a sole plate having a peripheral edge rigidly connected to the bounding edge of an opening defined by the bottom wall, whereby the sole plate closes the opening, the ridge and recesses being in part defined by the sole plate.

In addition, the bottom wall or sole plate **22*a* is seen to define major extents of the shallow recesses 162' and 164'**; each recess has a downwardly facing surface, and that surface is downwardly concave in a front-to-rear direction; and each recess downwardly facing surface is also downwardly concave in a toe-to-heel direction.

Figure 28:
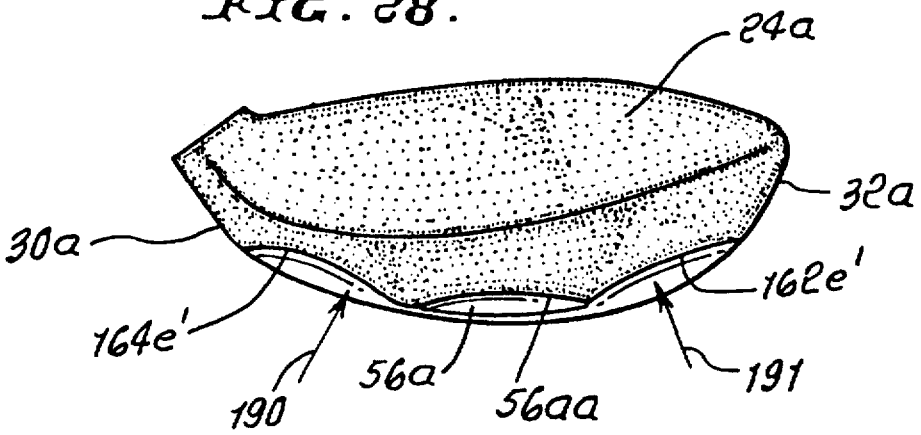
FIG. 28 is rear elevation view of the FIG. 23 head.
Figure 29:
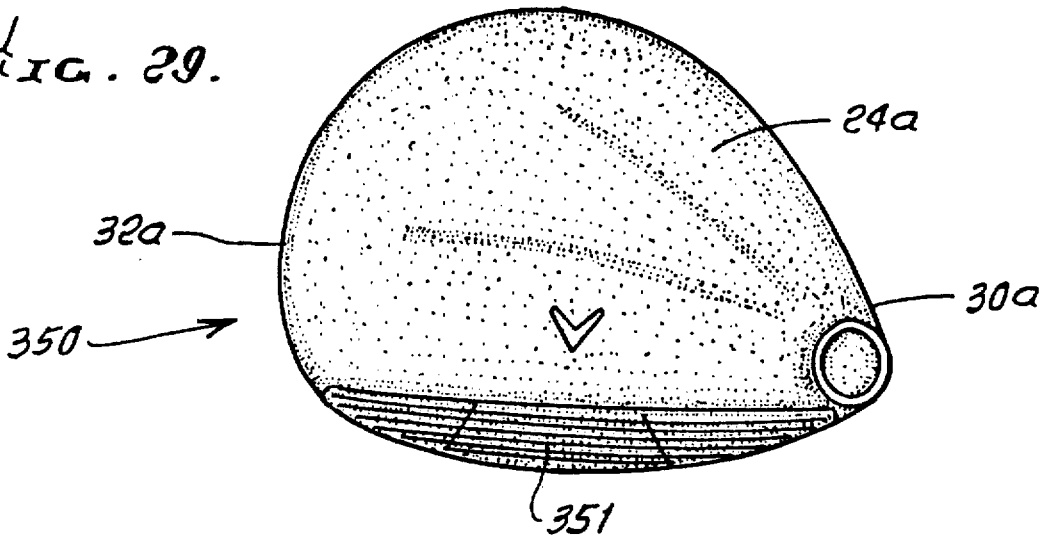
FIG. 29 is a top plan view of a golf club head, similar to the heads of FIGS. 10–28, but configured as a 4 wood.
Figure 30:
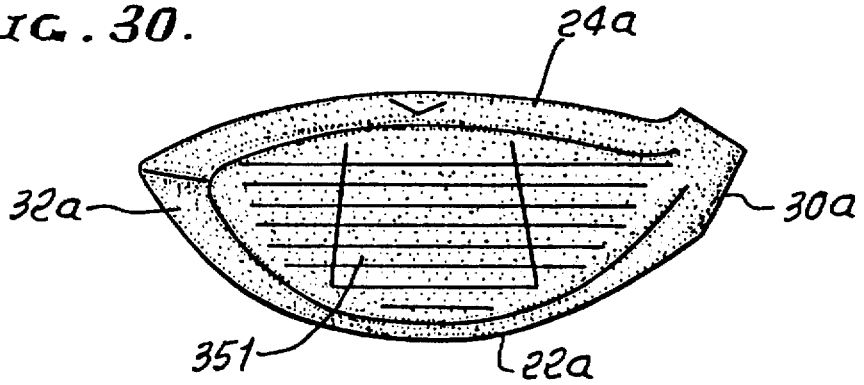
FIG. 30 is a front face elevation view of the FIG. 29 head.
Figure 31:
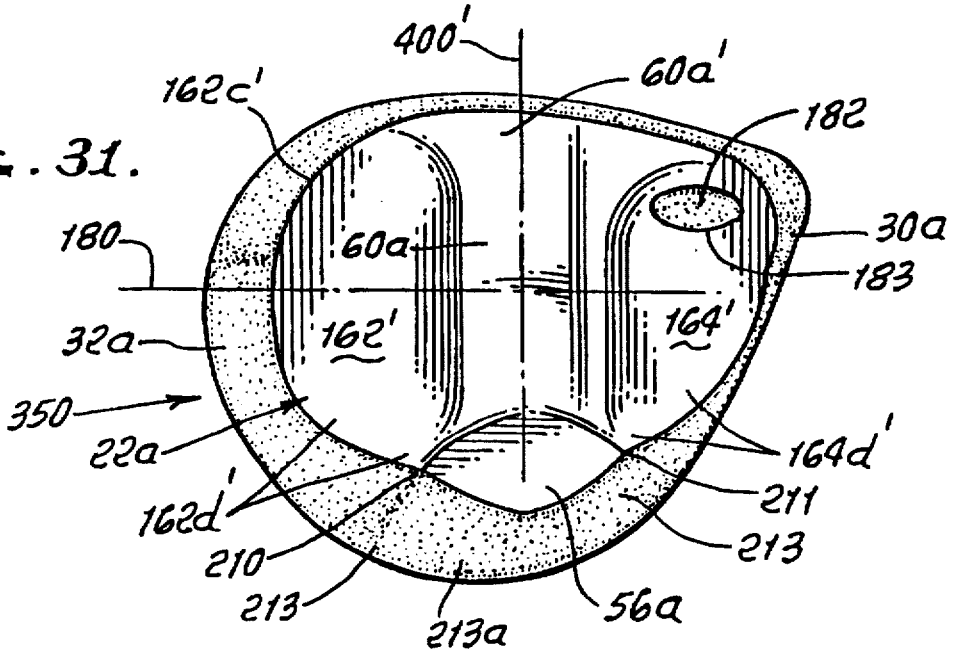
FIG. 31 is a bottom plan view of the FIG. 29 head.
Figure 32:
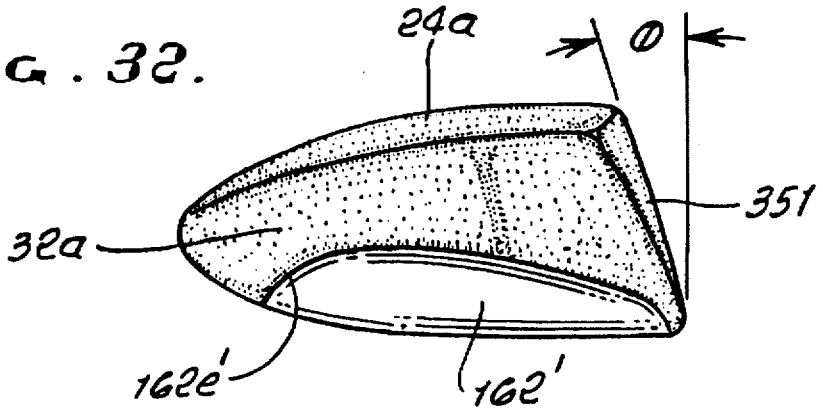
FIG. 32 is a toe end elevation view of the FIG. 29 head.
Figure 33:
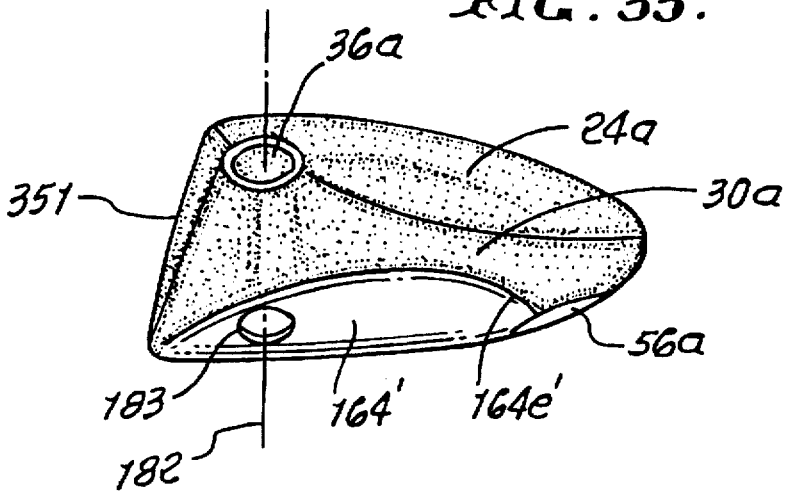
FIG. 33 is a heel end elevation view of the FIG. 29 head.
Figure 34:
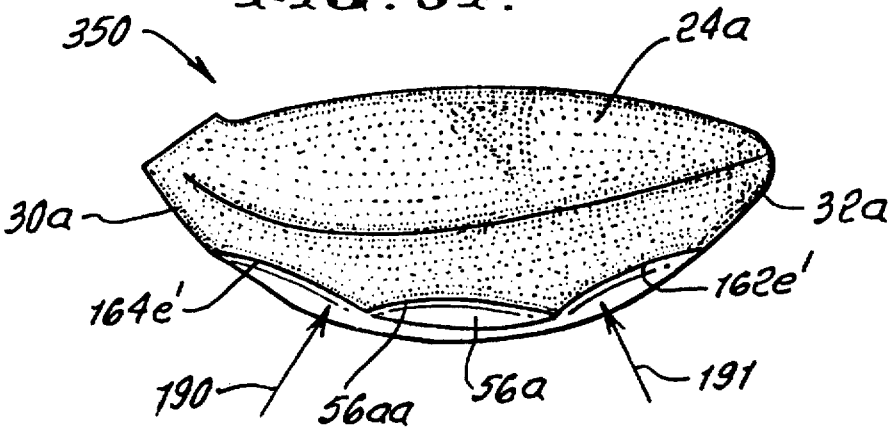
FIG. 34 is a rear elevation view of the FIG. 29 head.
Figure 35:
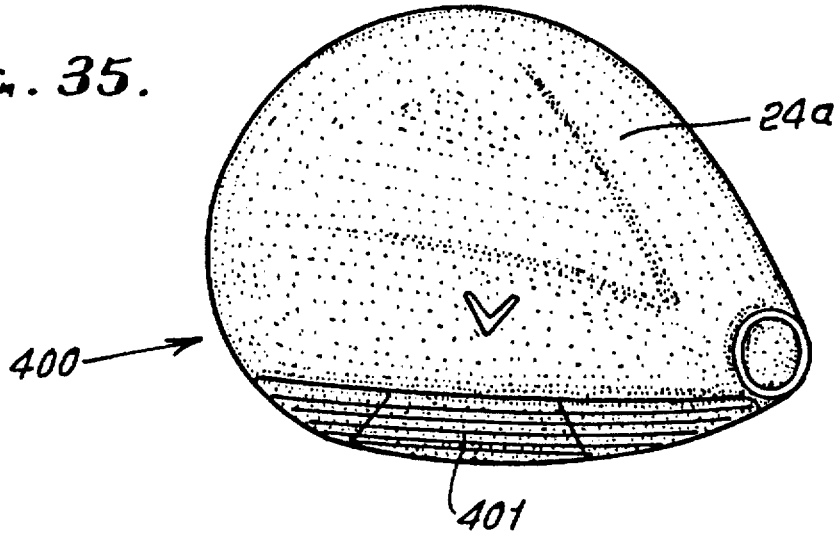
FIG. 35 is a top plan view of a golf club head, similar to the head of FIGS. 29–34, but configured as a 5 wood.
Figure 36:
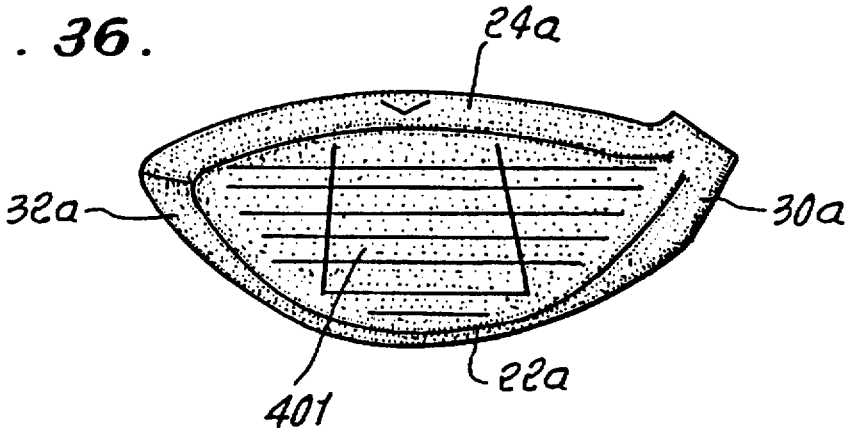
FIG. 36 is a front face elevation view of the FIG. 35 head.
Figure 37:
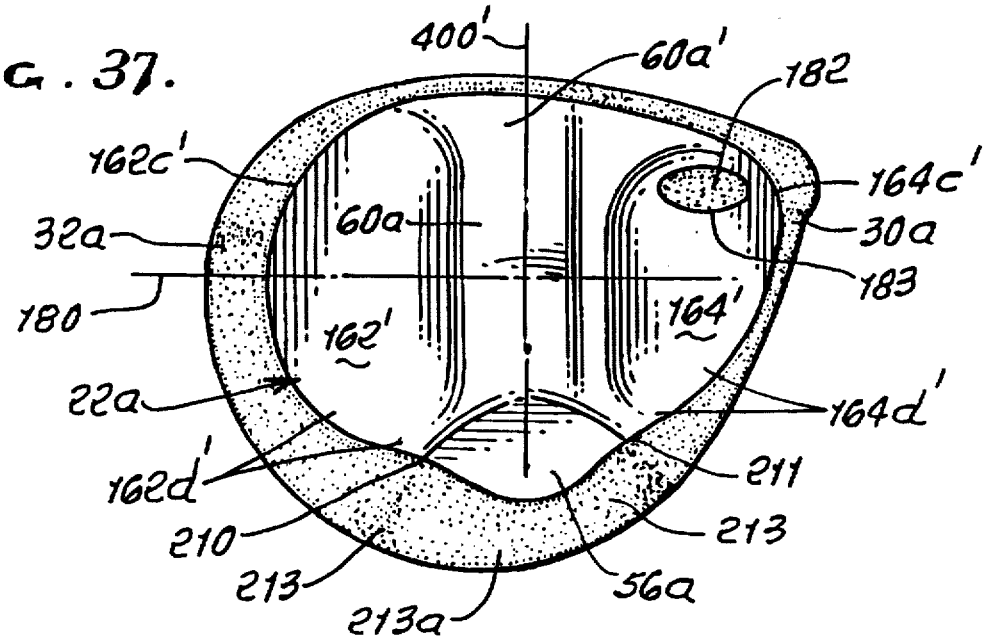
FIG. 37 is a bottom plan view of the FIG. 35 head.
Figure 38:
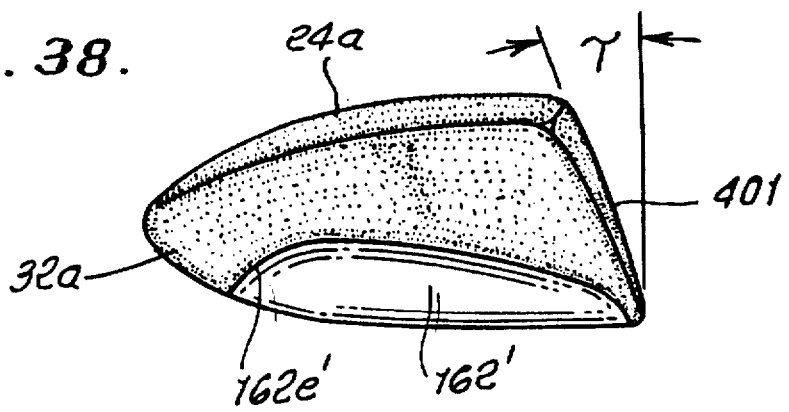
FIG. 38 is a toe end elevation view of the FIG. 35 head.
Figure 39:
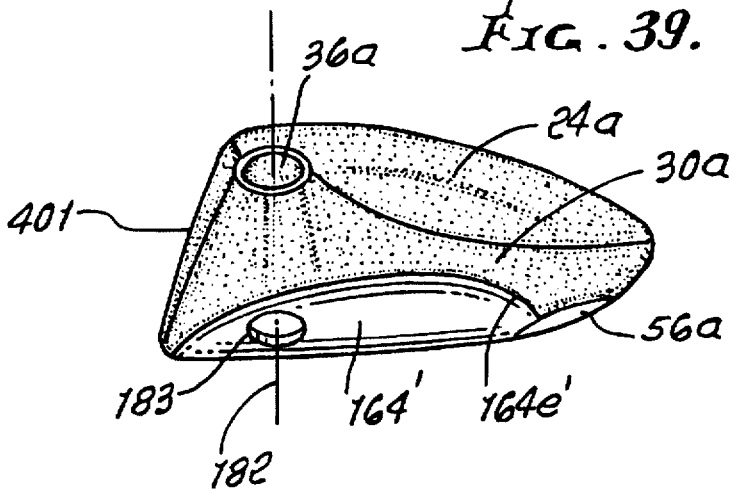
FIG. 39 is a heel end elevation view of the FIG. 35 head.
Figure 40:
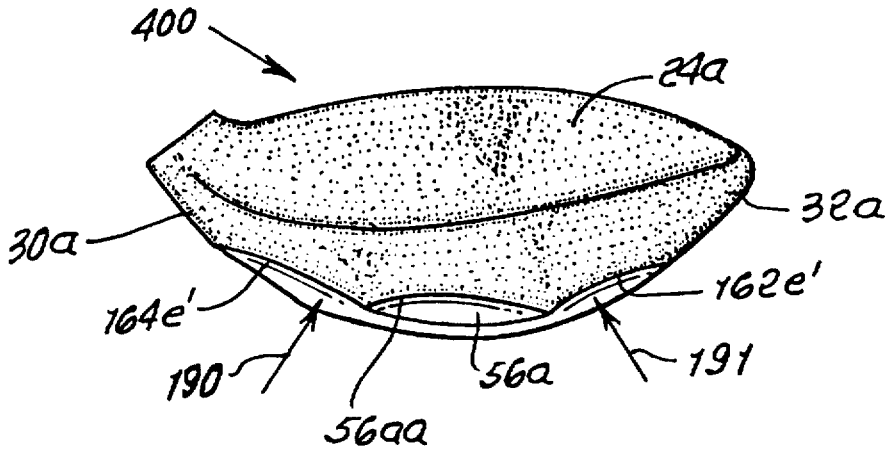
FIG. 40 is a rear elevation view of the FIG. 35 head.

Referring to FIG. 28, the recesses 162' and 164' have edges **162*e*' and 164*e*', which, when viewed from the rear of the head, are upwardly convex. The rearward edge 56*aa* of flattened beveled surface 56*a* is also upwardly convex in FIG. 33, and located approximately mid way between edges 162*e*' and 164*e*'. Such convex edges extend in an arcuate row, as seen in FIG. 28, and define a V-shape. Upward lift force vectors appear at 190 and 191**, and result from engagement of the inclined rear portions of the inclined rear portions of the dished recess surfaces with the turf, as referred to above. Note that the vectors are angled upwardly and toward one another.

Each of the heads of FIGS. 10–40 has generally the same construction, and the corresponding elements bear the same numbers. Generally speaking, it may be said that, for each head, its bottom wall has upwardly dished wall extent, which defines downwardly facing surface means inclined forwardly and upwardly relative to the head swing path, as the bottom wall engages the turf, so that the turf moving relatively rearwardly engages the inclined surface means, for creating lift force acting to urge the bottom wall and the head in an upward direction.

The upwardly recessed wall extent more specifically may define two dished, shallow recesses at toe and heel sides, respectively of a medial ridge, the recesses everywhere spaced rearwardly from the front wall—one recess having an arcuate peripheral edge generally convex toward the heel portion and the other recess having an arcuate peripheral edge generally convex toward the toe portion—the recesses being located in substantially mirror-imaged positions, with respect to a forwardly extending vertical plane bisecting the ridge.

The internal construction of the heads of FIGS. 10–40 may, if desired, be the same as that of the FIG. 1–9 head. Plastic filler material may be incorporated in the head interior shown at 196.

Referring again to FIG. 13, the head is further characterized by the following:

i) the dished recesses 162' and 164' are located in substantially mirror-imaged position, with respect to a forwardly extending, vertical plane 400' bisecting the ridge 60*a*';

ii) the convergent rearward terminus of dished recess rearwardmost extent 162*d*' is intersected by a cusp 210 defined by surface or bevel 56*a*; and the convergent rearward terminus of dished recess rearwardmost extent 164*d*' is intersected by a cusp 211, also defined by bevel 56*a*; these cusps are further defined by intersection of the bevel with head rounded outer bottom surface 213, and intersection of the bevel with the ridge rearwardmost and rearwardmost divergent extents, as shown; the cusps 210 and 211 are substantially equidistant from the head front face 201, whereby the bevel is centered between the rearwardmost extents 162*d*' and 164*d*' of the recesses;

iii) plane 400' also bisects the bevel, so that cusps 210 and 211 are located at substantially equal distances from the plane; and the plane 400' also intersects the rearwardmost extent 213*a* of the head. Note the ridge 60*a* is divergent, forwardly.

The above features, also found in FIGS. 19, 25, 31, and 37 contribute to the balanced lift force creation discussed above.

Figure 45:
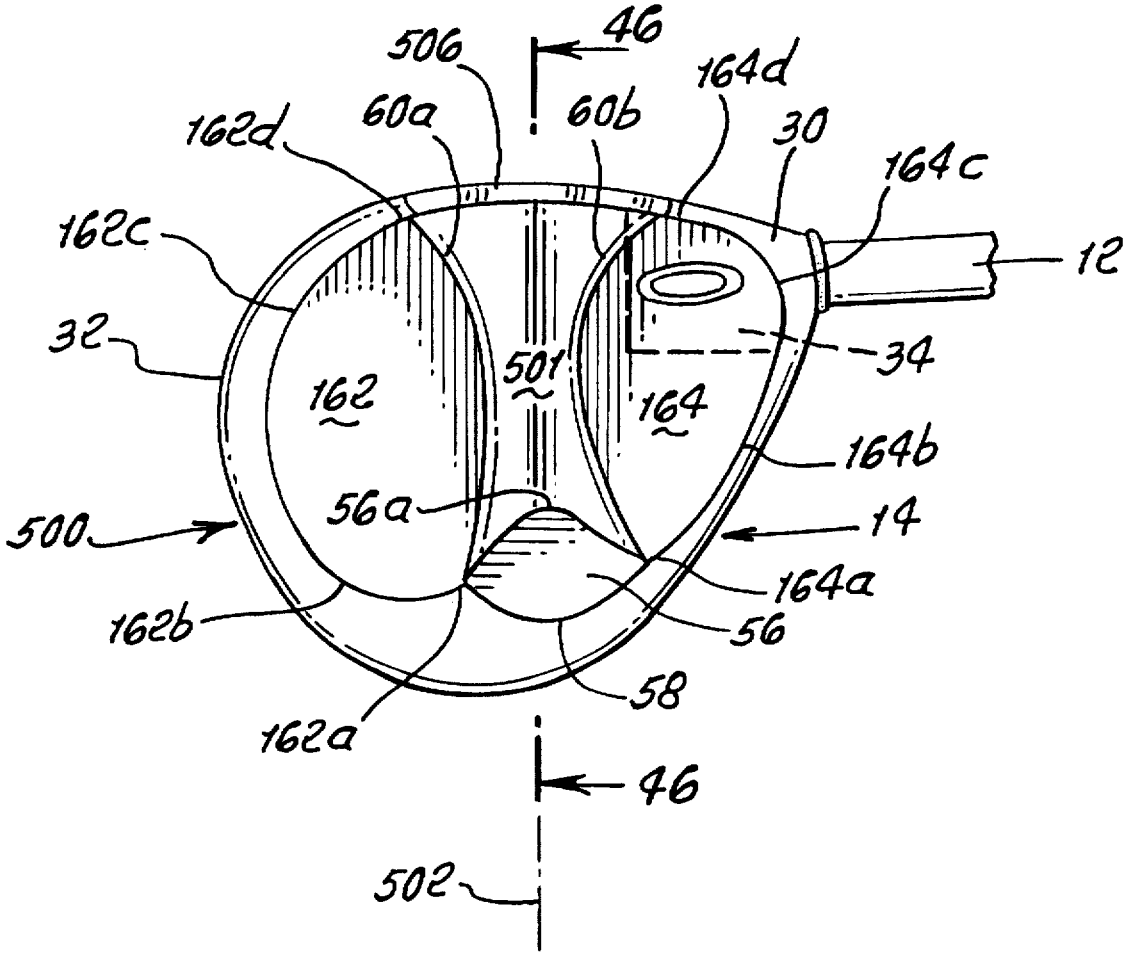
FIG. 45 is a bottom view of a head like that of FIG. 2 showing modification.
Figure 46:
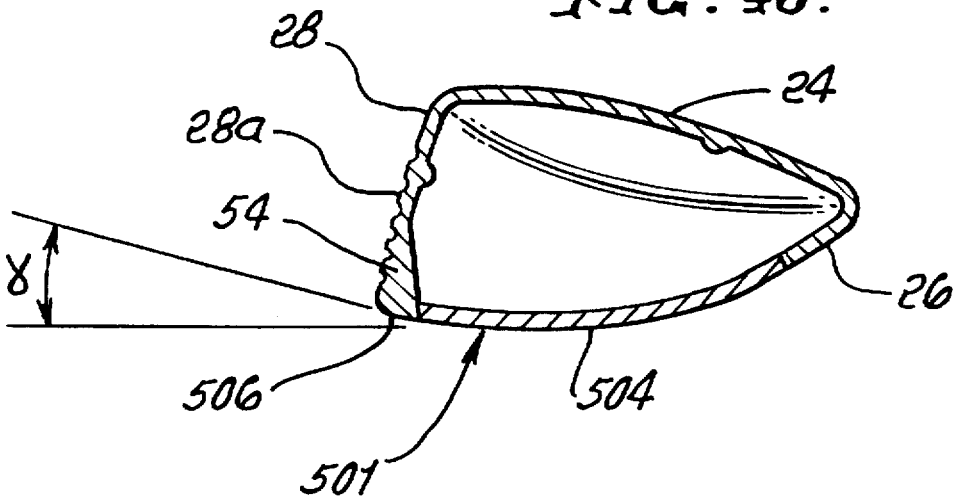
FIG. 46 is a section taken on lines 46—46 of FIG. 45 and is like FIG. 6.

Referring now to FIGS. 45 and 46, the head 500 construction is the same as that of head 10 of FIGS. 2 and 6, with the following modifications. It will be noted that the medial ridge 501 (similar to ridge 60) has shallow, downward convexity, as appears in an upright plane 502 (the plane of FIG. 46) that extends forwardly and intersects the ridge. Plane 502 is shown as bisecting the ridge 501 in a front-to-rear direction relative to the head, the intersection with 501 located at the lowermost extent of that ridge, as designated by line 504 in FIG. 46. Such convexity, or downward bulging, typically extends throughout the major length of the medial ridge 501, as shown in FIG. 45, and also extends widthwise of the ridge and to the forwardly and rearwardly diverging extents of the ridge.

In addition, the metallic head bottom wall terminates forwardly, as a locally beveled portion 506 that is sloped forwardly and upwardly at an angle $\gamma'$ (see FIG. 46) that is substantially less than 45° relative to horizontal. Angle $\gamma'$ is preferably between 22° and 38°, and typically is about 30°. Bevel 506 merges with the forwardmost extent of the downwardly convex ridge bottom.

Each of these modifications, i.e., the ridge downward convexity (see line 504) and the beveled portion 506 contributes to a desirable bounce effect as the head bottom wall encounters the turf, as during rapid swinging of the club, whereby loss of forward momentum of the head just prior to or during impact with the golf ball is minimized. The combination of these two modifications optimize the bounce effect referred to.

Figure 47:
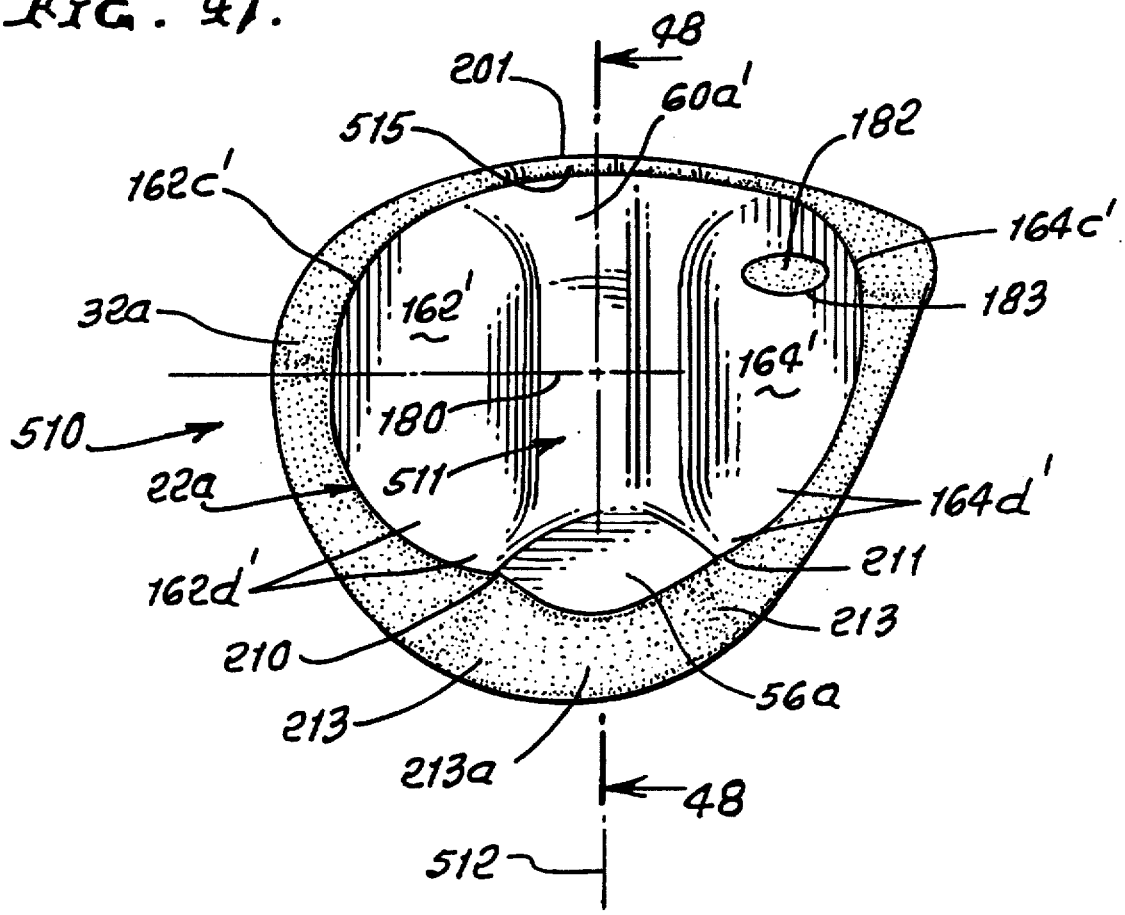
FIG. 47 is a bottom view of a head like that of FIG. 13 showing modification.
Figure 48:
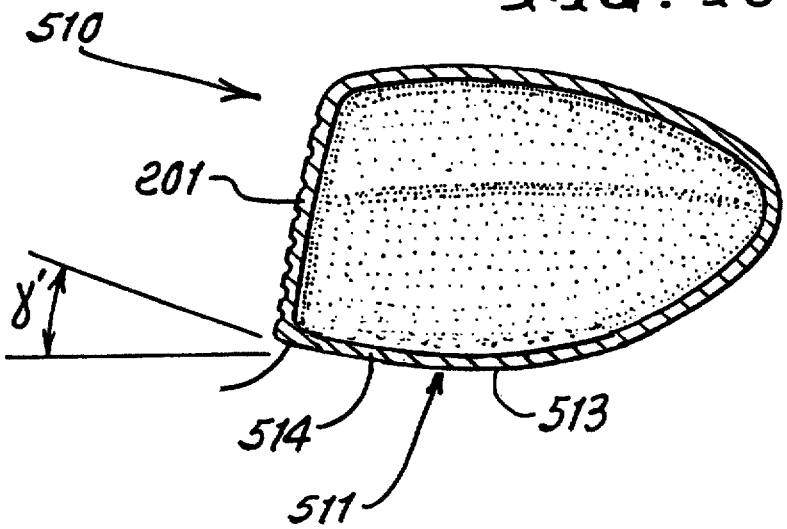
FIG. 48 is a section taken on lines 48—48 of FIG. 47.

Referring now to FIGS. 47 and 48, the head 510 construction is the same as, i.e., representative of, that of FIGS. 13–16 (or any of the heads of FIGS. 17–22, or 25–28, or 31–34, or 37–40), with modifications like those as described above for FIGS. 45 and 46. See in this regard the medial ridge 511 (similar to ridge 60*a*) having shallow downward convexity, as appears in the forward and upright plane 512 (the plane of FIG. 48). That plane bisects ridge 511. Convexity, as represented by line 513, extends throughout the major length of the ridge.

In addition, the metallic head bottom wall 514 terminates forwardly as a locally beveled portion 515, sloping forwardly and upwardly at angle $\gamma'$, substantially less than 45° (and preferably between 22° and 38°, i.e., typically about 30°), and merging with the forwardmost extent of the downwardly convex ridge bottom. The advantages of such modification are described above.

Figure 49:
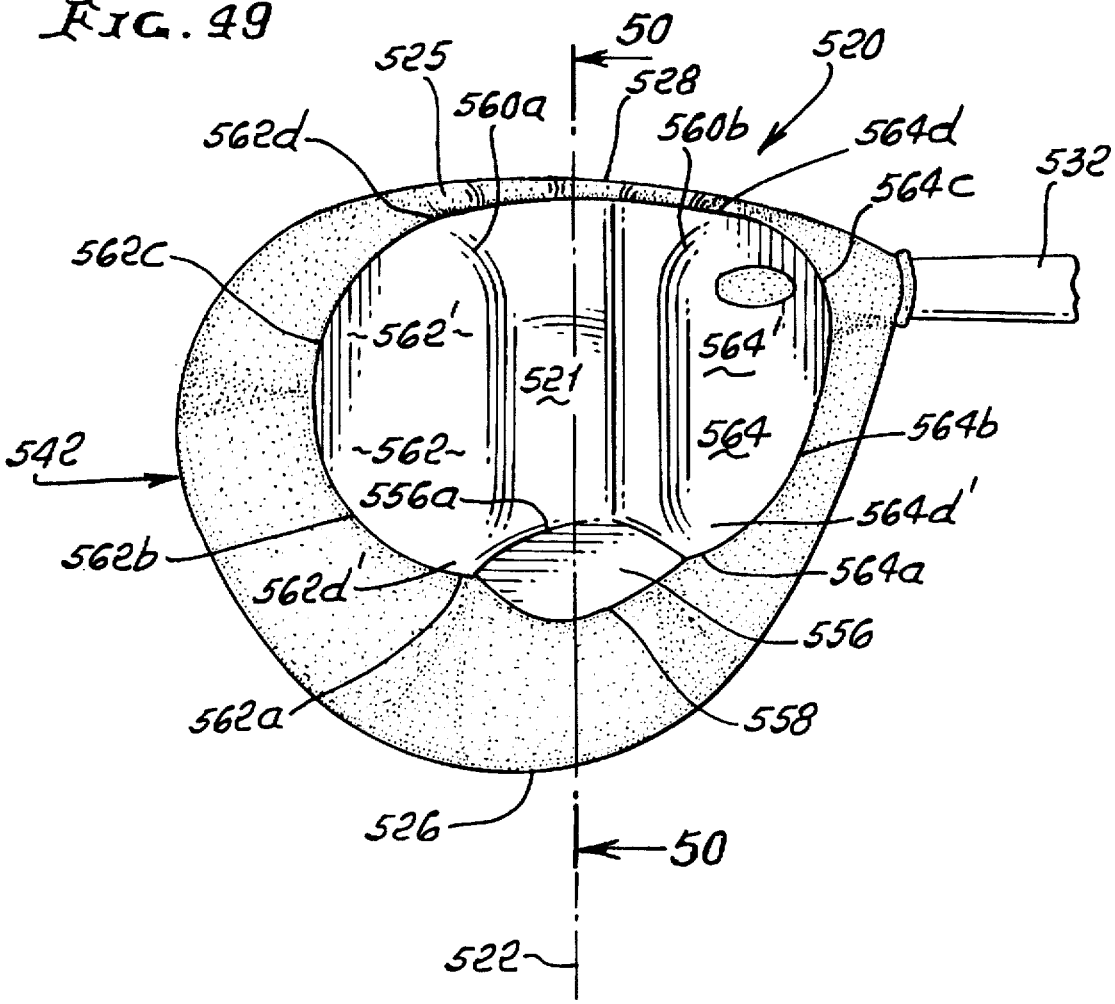
FIG. 49 is a bottom view of a larger head, with similarity to the head of FIG. 47.
Figure 50:
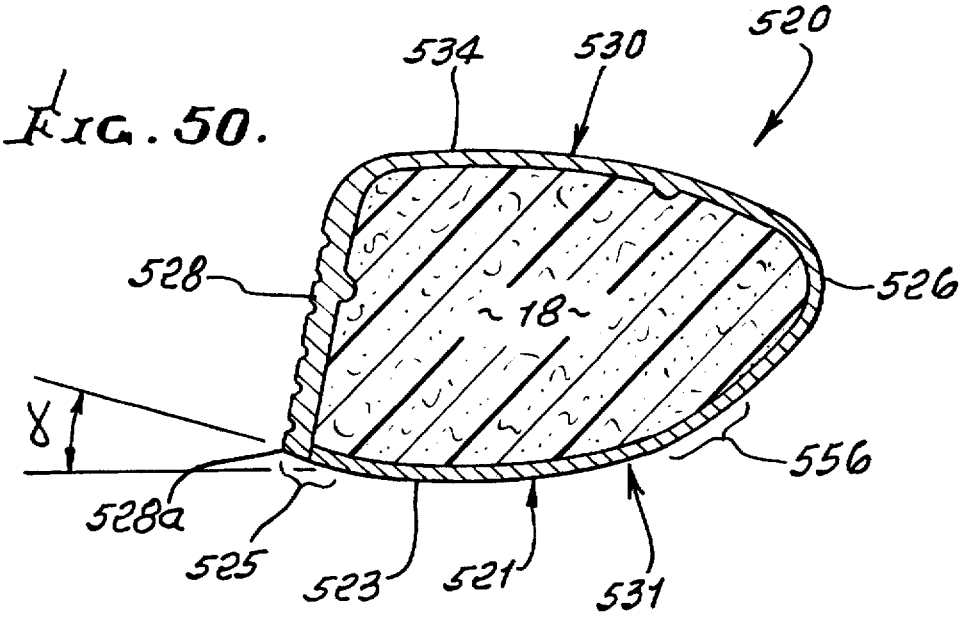
FIG. 50 is a section taken on lines 50—50 of FIG. 49.

Referring to FIGS. 49 and 50, the larger head 520 construction also has modifications like those described above for FIGS. 47 and 48. See in this regard the medial ridge 521 having shallow downward convexity, as appears in the forward and upright plane 522 (the plane of FIG. 50). That plane bisects ridge 521. Downward convexity or bulging, as represented by line 523, extends throughout the major length of the ridge.

Note also the locally beveled portion 525 of the head bottom wall forwardmost extent, and laterally along its U-shaped extent. The angularity $\gamma'$ of the beveled portion is as discussed above for FIGS. 47 and 48. The head of FIGS. 49 and 50 is typically metallic, and may consist of titanium or titanium alloy, for high strength.

Further, the head 520 is in the configuration of a "wood" club, although it is made of metal. It comprises a hollow, metal shell, which may be filled with a plastic foam filling 18, preferably polyurethane.

The shell is preferably made of titanium or titanium alloy; and it may be fabricated by the "lost wax" casting method that is well known in the art. The shell is formed in two pieces: a main portion 530 and a sole plate 531 that is peripherally welded to the main portion.

The main shell portion has a top surface 534, a rear surface 526, and a ball-striking surface or face 528 opposite the rear surface 526. The face 528 is angled with respect to the vertical with a specified "pitch" that is determined by the type of club and the amount of loft desired. The end portion of the head proximate the shaft 532 is commonly termed the "heel", while the end portion opposite the heel is termed the "toe" 542. As shown in FIG. 49, the front face 525 is typically curved from the heel to the toe.

As shown in the drawings, the bottom wall is characterized as forming the medial ridge 521, and as forming two shallow recesses—one recess between the ridge and the heel portion, and the other recess between the ridge and the toe portion—the recesses everywhere spaced rearwardly from the front wall, the one recess having an arcuate peripheral edge generally convex toward the heel portion, and the other recess having an arcuate peripheral edge generally convex toward the toe portion. Examples of such shallow, upwardly dished recesses are seen at 562 between the ridge 521 and the toe 542, and at 564 between the ridge and heel.

Recess 562 curved periphery extends in a looping edge path, indicated at 562*a*, 562*b*, 562*c*, and 562*d*. Recess 564 also extends in a looping edge path indicated at 564*a*, 564*b*, 564*c*, and 564*d*, both paths located on the bottom wall, as shown. The maximum depth of each recess below a plane containing its peripheral looping edge path is less than ¼ inch, and preferably between 1/16 inch and 3/16 inch. These depths are sufficient to avoid direct frictional contact of recess dished inner surfaces 562' and 564' with the ground during a club stroke, ground contact, if any, being confined to the lowermost extent of the central ridge 521, and to recess peripheral or rearward wall extents, as will appear.

Also, the upward bi-directional concavity of the bottom wall extents 562' and 564' forming the recesses adds to bottom wall strength, and stiffness, for transmitting shock loading transmitted to and from the front wall 525 during ball stroking. The bottom wall thickness may then be minimized and metal "redistributed" to enable provision of a larger sized head.

Note also the provision of a bottom wall rearwardly divergent surface, or bevel, which extends at a rearwardly and upwardly extending angle, beyond rearward extent of the ridge, and between rearward extents of the recesses.

Specifically, there is a trailing, beveled surface 556, which is a relieved, upwardly angled, somewhat flattened portion extending upwardly from a curved edge 556*a* and between that edge and the center of the sole, and a trailing edge 558 at the juncture between the rear surface 526 of the club head and the sole plate 531. The lowermost curved part 556*a* of the surface 556 is contiguous with the rearward end of ridge 521 that extends forward toward and diverges at 560*a* and 560*b* to merge with beveled portion 525 extending laterally to in turn merge with the bottom U-shaped front edge 528*a* of the face of the club head, edge 528*a* being addressed toward the turf, above beveled portion 525, as the head is swung, portion 525 providing "bounce".

Referring now to the perspective view FIG. 51, a golf club head 600 is schematically represented, with a toe in region 601, heel in region 602, a forwardly facing ball-striking face 603, and top and bottom walls in region 604 and 605. The bottom wall has downward convexity in a front-to-rear direction, as represented by curved line 606, and downward convexity in a toe-to-heel direction, as represented by curved line 607. Also, the bottom wall has a lowermost local zone 608 toward which the convexities (as represented by lines 606 and 607) converge in ball-addressing position of the head.

Figure 55:
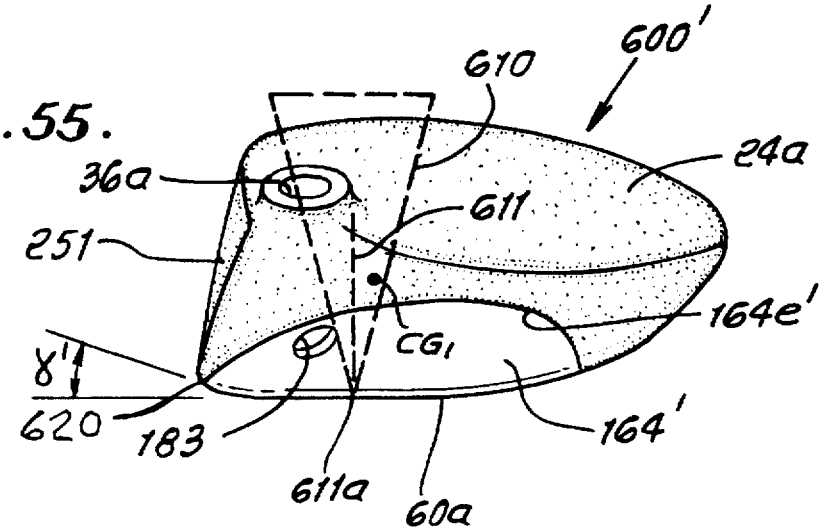
FIG. 55 is a heel-end elevation view of the FIG. 53 head, and like FIG. 21.
Figure 56:
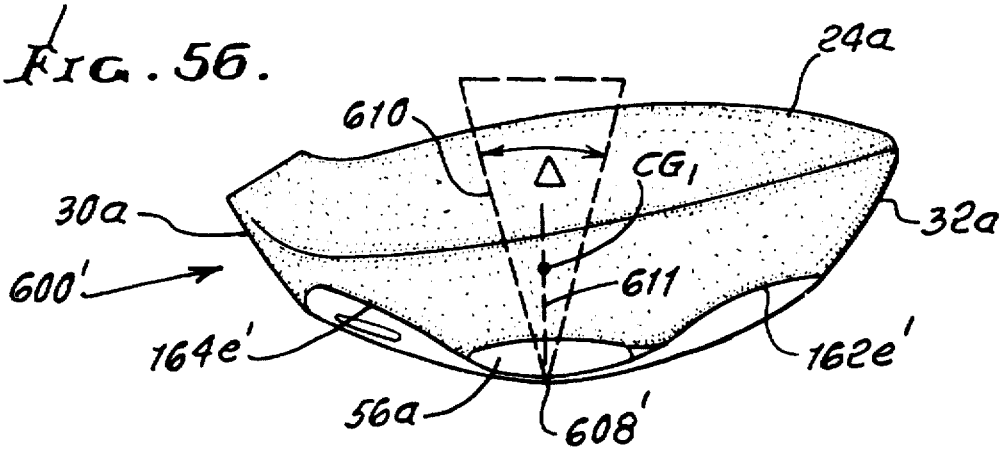
FIG. 56 is a rear elevational view of the FIG. 53 head, and like FIG. 22.

Such a ball-addressing position of a head 600' is shown in FIG. 55. Note in FIG. 51 that the head center of gravity $CG_1$ is located in vertical alignment with the center of zone 608. Other possible center of gravity locations are indicated at $CG_2$ and $CG_3$, also in vertical alignment with zone 608, but shifted slightly off center.

FIG. 52 shows zone 608 reduced to an apex 608' at the intersection of the convexities indicated by lines 606 and 607. The center of gravity $CG_1$ is shown as located vertically above that apex; however, it may lie within an upwardly divergent cone indicated by broken lines at 610. That cone originates at apex 608', and has a vertical axis indicated at 611. The cone defines an included angle Δ of about 15°.

Improved "bounce" effects are obtained by providing a head construction, in accordance with the above.

Figure 54:
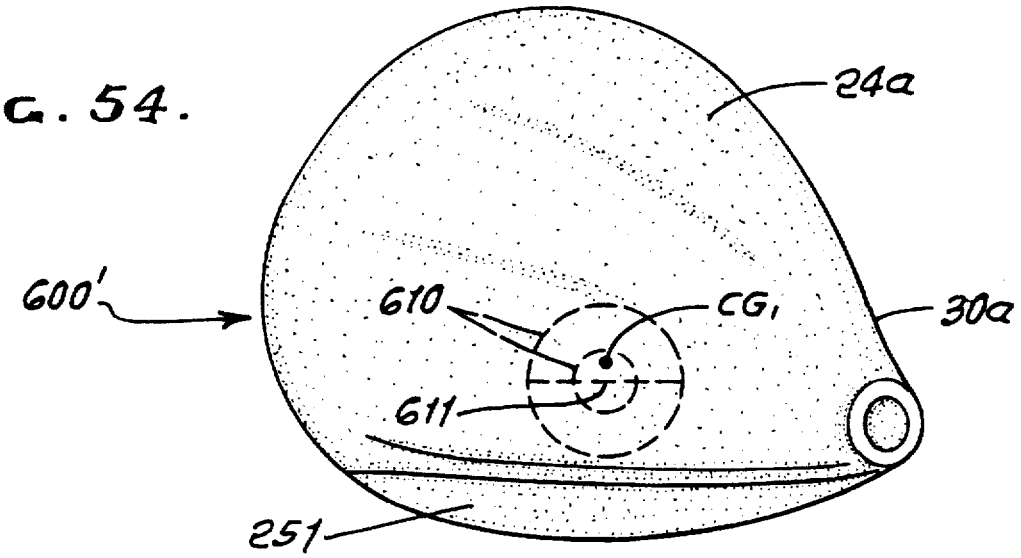
FIG. 54 is a top plan view of the FIG. 53 head, and like FIG. 17.

FIGS. 53–56 show the above principles incorporated into a head 600', having elements the same as those of the head of FIGS. 17–22. In this case, the cone axis 611 intersects the ridge 60*a* at a lowermost local zone reduced to apex 608'. Note cone 610 having vertical axis 611. In FIGS. 53–55, the CG is shown as located rearwardly of axis 611, but within the 15° included angle cone. The ridge has a bi-convexity, as referred to in FIGS. 51 and 52, and forward bevel is shown at 620 in FIG. 55. Each of the heads described herein may be considered as incorporating a CG located as described.

A set of such heads may be provided, as described. All of the heads described herein may have the center of gravity location, as referred to in FIGS. 51–56.

We claim:

1. In combination with a golf club head comprising a shell having toe and heel portions, a front wall defining a forward facing ball-striking face, and top and bottom walls, said bottom wall characterized as having a medial ridge, and as forming two shallow recesses, one recess between the ridge and the heel portion, and the other recess between the ridge and the toe portion, said recesses everywhere spaced rearwardly from said front wall, the improvement comprising said medial ridge having a lower surface defining a first shallow downward convexity in a first upright plane extending longitudinally forwardly and intersecting the ridge, said lower surface defining a second downward convexity in a second upright plane extending laterally in a toe-to-heel direction, said ridge having a lowermost local zone, said lowermost local zone located proximate an intersection of said first and second downward convexities, and the head having a center of gravity located in substantially vertical alignment with said local zone.

2. The club head of claim 1 wherein said medial ridge increases in width along said downward convexity and toward said front wall and beyond forward extents of said recesses.

3. The club head of claim 1 wherein said bottom wall has a locally flattened, rearwardly divergent surface that extends at a rearwardly and upwardly extending angle, beyond a rearward extent of said ridge downward convexity, and between rearward extents of said recesses.

4. The club head of claim 1 wherein said upright plane bisects said ridge in a front-to-rear direction relative to the head.

5. The club head as defined in claim 4 wherein said two recesses have a similar configuration with respect to said first vertical plane.

6. The club head of claim 1 wherein said first shallow downward convexity extends throughout the major length of said ridge.

7. The club head of claim 1 wherein said recesses have downward facing surfaces with a shallow upwardly dished configuration, at opposite sides of said ridge.

8. The club head of claim 7 wherein said downward facing surfaces are concave in front-to-rear directions.

9. The club head of claim 8 wherein said downward facing surfaces are also concave in a direction between the heel and toe.

10. The club head of claim 1 wherein said bottom wall defines an opening having a bounding edge, and said bottom wall is in part defined by a sole plate having a peripheral edge rigidly connected to said bounding edge of said opening, whereby the sole plate closes said opening, said ridge having said downward convexity and said recesses being in part defined by the sole plate.

11. The club head of claim 1 wherein said recesses have surfaces that merge with opposite sides of said ridge, proximate said first downward convexity.

12. The club head of claim 1 wherein said front wall has a lowermost U-shaped configuration, forwardly of said ridge, and said recesses.

13. The club head of claim 12 wherein said bottom wall terminates forwardly at a beveled portion that is sloped forwardly and upwardly at an angle substantially less than 45°, relative to horizontal.

14. The club head of claim 13 wherein said beveled portion extends proximate a forwardmost extent of said ridge.

15. The club head of claim 14 wherein said beveled portion also extends forwardly of said recesses.

16. The club head of claim 14 wherein said downward shallow convexity merges with said beveled portion that extends at the forwardmost extent of the head.

17. The head as defined in claim 1 wherein there is a substantially continuous, hollow, metallic tube extending within the shell proximate the heel portion and from proximate the shell top wall to proximate the shell bottom wall, said tube having a bore to receive a club shaft, said bore aligned with said one shallow recess, in spaced relation to said ridge first downward convexity.

18. A set of golf club heads, each golf club head comprising a shell having toe and heel portions, a front wall defining a forward facing ball-striking face, and top and bottom walls, said bottom wall characterized as having a medial ridge, and as forming two shallow recesses, one recess between the ridge and the toe portion, said recesses everywhere spaced rearwardly from said front wall, the improvement comprising said medial ridge having a lower surface defining a first shallow downward convexity in a first upright plane extending longitudinally forwardly and intersecting the ridge, said lower surface defining a second downward convexity in a second upright plane extending laterally in a toe-to-heel direction, said ridge having a lowermost local zone, said lowermost local zone located proximate an intersection of said first and second downward convexities, and the head having a center of gravity located in substantially vertical alignment with said local zone, wherein each recess has a downward facing surface, and is further characterized in that the rearwardmost extent of said downwardly facing surface is inclined forwardly and upwardly relative to the head forward swing path as the head bottom wall engages the turf, said rearwardmost extent of said downwardly facing surface being offset from said ridge first downward convexity.

19. In combination with a golf club head comprising a shell having toe and heel portions, a front wall defining a forward facing ball-striking face, and top and bottom walls, said bottom wall characterized as having a medial ridge, and as forming two shallow recesses, one recess between the ridge and the heel portion, and the other recess between the ridge and the toe portion, said recesses everywhere spaced rearwardly from said front wall, the improvement comprising said bottom wall terminating forwardly at a beveled portion that is sloped forwardly and upwardly at an angle substantially less than 45°, relative to horizontal, and forwardly of said recesses and said ridge, the head having a center of gravity above a lowermost zone of the ridge.

20. The club head of claim 19 wherein said angle is between 22° and 38°.

21. The club head of claim 19 wherein said beveled portion extends at the forwardmost extent of said ridge, said ridge has a lowermost local zone, in ball-addressing position of the head, and the head center of gravity is located in substantially vertical alignment with lowermost extent of said bottom wall which is bi-directionally downwardly convergent.

22. The club head of claim 21 wherein said beveled portion also extends forwardly of said recesses.

23. The club head of claim 21 wherein said ridge merges with said beveled portion that extends at the forwardmost extent of the head.

24. A golf club head comprising a shell having toe and heel portions, a front wall defining a forwardly facing ball-striking face, and top and bottom walls, the bottom wall defining a downwardly projecting medial ridge that extends forwardly toward said front face and defines a lower surface, said medial ridge having first shallow downward convexity in a first upright plane that extends longitudinally forwardly and intersects the ridge, said lower surface defining a second downward convexity in a second upright plane extending laterally in a toe-to-heel direction, said ridge having a lowermost local zone, said local zone located proximate an intersection of said first and second downward convexities, and the head having a center of gravity located in substantially vertical alignment with said local zone.

25. The club head of claim 24 wherein said ridge terminates forwardly at a beveled portion that is sloped forwardly and upwardly at an angle substantially less than 45°, relative to horizontal.

26. A golf club head having a toe, a heel, a forwardly facing ball-striking face, and top and bottom walls, the bottom wall having downward convexity in a front-to-rear direction, and downward convexity in a toe-to-heel direction, said bottom wall having a lowermost local zone toward which said convexities converge, in ball-addressing position of the head, and the head having a center of gravity located in vertical alignment with said local zone.

27. The head of claim 26 wherein said local zone defines an apex toward which said convexities converge.

28. The head of claim 27 wherein said center of gravity is located within an upwardly divergent cone originating at said apex, the cone having a vertical axis and defining a 15° included angle.

29. The head of claim 26 wherein said center of gravity is located within an upwardly divergent cone originating at said local zone, the cone having a vertical axis and defining an included angle substantially less than 30°, said head defining a downwardly projecting ridge extending forwardly and rearwardly, said cone axis intersecting said ridge.

30. The head of claim 29 wherein said ridge diverges forwardly and terminates at a bevel that slopes forwardly and upwardly at an angle substantially less than 45°.

31. A golf club head having a toe, a heel, a forwardly facing ball-striking face, and top and bottom walls, the bottom wall having the following:

i) downward convexity in a front-to-rear direction, ii) downward convexity in a toe-to-heel direction, said bottom wall having a lowermost local zone toward which said convexities extend in ball-addressing position of the head, and the head having a center of gravity located in substantially vertical alignment with said local zone said head consisting essentially of titanium.

32. The head of claim 31 wherein said local zone defines an apex toward which said at least one convexity extends.

33. The head of claim 32 wherein said center of gravity is located within an upwardly divergent cone originating at said apex, the cone having a vertical axis and defining a 15° included angle.

34. The head of claim 31 wherein said center of gravity is located within an upwardly divergent cone originating at said apex, the cone having a vertical axis and defining a 15° included angle.

35. The head of claim 34 wherein said ridge diverges forwardly and terminates at a bevel that slopes forwardly and upwardly at an angle substantially less than 45°.

36. A golf club head comprising a body having toe and heel portions, a front wall defining a ball-striking face, and top and bottom surfaces, said bottom surface characterized as having a forwardly extending medial ridge, and as forming two shallow recesses, one recess between the ridge and the heel portion, and the other recess between the ridge and the toe portion, said recesses spaced rearwardly from said front wall, said recesses being located in substantially mirror imaged positions with respect to a forwardly extending vertical plane bisecting said ridge, the ridge bottom surface defining a downwardly convex bi-directional convergence zone, and the head having a center of gravity located vertically above said convergence zone.

37. The club head of claim 36 wherein said medial ridge increases in width toward said front wall and between forward extents of said recesses.

38. The club head of claim 37 which is metallic and consists essentially of titanium.

39. The club head of claim 36 wherein said bottom surface has a bevel that extends at a rearwardly and upwardly extending angle, beyond rearward extent of said ridge, and between rearward extents of said recesses.

40. The club head of claim 36 wherein said recesses have downward facing surfaces with shallow upwardly dished configuration.

41. The club head of claim 40 wherein said downward facing surfaces are concave in front-to-rear directions.

42. The club head of claim 41 wherein said downward facing surfaces are also concave in directions between the heel and toe.

43. The club head of claim 36 wherein said bottom surface is in part defined by a sole plate having a peripheral edge rigidly connected to the bounding edge of an opening defined by said bottom wall, whereby the sole plate closes said opening, said ridge and recesses being in part defined by the sole plate.

44. The club head of claim 36 wherein said recesses have surfaces that merge in arcuate relation with opposite sides of said ridge.

45. The club had of claim 36 wherein said front wall has lowermost U-shaped configuration, forwardly of said ridge and recesses.

46. The club head of claim 36 wherein said head includes a sole plate peripherally connected to a body rim defining a bottom opening, said sole plate defining major extents of said shallow recesses.

47. The club head of claim 46 wherein said sole plate also defines said ridge.

48. The head of claim 36 wherein the head center of gravity is located at approximately 42% to 50% of the head height, as measured upwardly from said convergence zone to the uppermost head surface, viewed from the front of the head.

49. The club head of claim 36 which is metallic and comprises titanium.

50. The golf club head comprising a metallic body having toe and heel portions, a front wall defining a ball striking face, and top and bottom surfaces, the bottom surface characterized as having localized undulant and angled surface extents delineated within a first peripheral outline for turf engagement and for urging the head upwardly in response to turf engagement, the head, when viewed toward said bottom wall, presenting a second peripheral overall outline having substantial spacing from said first peripheral outline at least toward said toe portion and toward the head rear, the club head sloping arcuately upwardly and outwardly between said first and second outlines, said surface extents defining a forwardly extending ridge having a bottom surface defining a downwardly convex bi-directional convergence zone, and the head having a center of gravity located vertically above said convergence zone.

51. The head of claim 50 having its center of gravity located at approximately 42% to 50% of the head height, as measured upwardly from the convergence zone to the uppermost head surface, viewed from the front of the head.

52. A set of golf club heads, each head comprising a shell having toe and heel portions, a front wall defining a ball striking face, and top and bottom surfaces, the bottom surface characterized as having localized undulant and angled surface extents delineated within a first peripheral outline for turf engagement and for urging the head upwardly in response to turf engagement; the head, when viewed toward said bottom wall, presenting a second peripheral overall outline having substantial spacing from said first peripheral outline at least toward said toe portion and toward a head rear, the club head sloping arcuately upwardly and outwardly between said first and second outlines, said surface extents defining a forwardly extending ridge having a bottom surface defining a downwardly convex bi-directional convergence zone, and the head having a center of gravity located vertically above said convergence zone.

53. The set of heads, as defined in claim 52, wherein each head has a center of gravity located at approximately 42% to 50% of the head height, as measured upwardly from the lowermost head surface to the uppermost head surface, viewed from the front of the head.

* * * * *